US005726004A

United States Patent [19]

Weber et al.

[11] Patent Number: 5,726,004

[45] Date of Patent: Mar. 10, 1998

[54] PHOTOGRAPHIC MATERIAL

[75] Inventors: Beate Weber, Leichlingen; Jörg Hagemann, Köln, both of Germany

[73] Assignee: Agfa-Gevaert, Germany

[21] Appl. No.: 715,197

[22] Filed: Sep. 18, 1996

[30] Foreign Application Priority Data

Sep. 27, 1995 [DE] Germany ..... 195 35 939.9

[51] Int. Cl.[6] ..... G03C 1/34; G03C 1/42; G03C 1/04; G03C 7/327

[52] U.S. Cl. ..... 430/548; 430/512; 430/543; 430/551; 430/531; 430/566; 430/627; 430/628; 430/609

[58] Field of Search ..... 430/543, 551, 430/548, 627, 628, 609, 512, 566, 531; 524/99; 528/27

[56] References Cited

U.S. PATENT DOCUMENTS

| | | | |
|---|---|---|---|
| 4,004,927 | 1/1977 | Yamamoto et al. | 96/67 |
| 5,418,267 | 5/1995 | Carrozza et al. | 524/99 |
| 5,514,738 | 5/1996 | Borzatta et al. | 524/102 |
| 5,561,179 | 10/1996 | Borzatta et al. | 524/99 |

FOREIGN PATENT DOCUMENTS

| | | |
|---|---|---|
| 0 665 233 | 8/1995 | European Pat. Off. . |
| 25 04 025 | 8/1975 | Germany . |

OTHER PUBLICATIONS

Ciba–Geigy AG, "Stabilisers for Materials for reroduction", *Research Disclosure* No. 31429, Jan. 1990.

*Primary Examiner*—Richard L. Schilling
*Attorney, Agent, or Firm*—Connolly & Hutz

[57] ABSTRACT

A photographic material having at least one photosensitive silver halide emulsion layer and at least one non-photosensitive layer on a support, which material contains at least one compound of the formula (I) in at least one of the layers, (I)

in which $R_1$ to $R_5$, L, m and n have the meaning stated in the specification and PUG means a photographically active group, may be produced in thinner layers.

9 Claims, No Drawings

PHOTOGRAPHIC MATERIAL

This invention relates to a photographic material which contains photographically active compounds (PUG) covalently bonded to a certain polymer and which may consequently be produced with thinner layers.

It is known to use polysiloxanes in photographic materials in the oil phase during emulsification of colour couplers (for example EP 555 923) or as a lubricant.

If the polysiloxanes are used according to EP 555 923 as an additive to the oil phase, in which a colour coupler, for example, is dissolved or dispersed, while improved stability of the phase against crystallisation is indeed achieved, such use is associated with other disadvantages. For example, the dye stability of the dye formed from the coupler is inadequate.

The object of the invention was to incorporate photographically active compounds into the layers of a photographic material in such a manner that the following conditions are fulfilled:

1. elevated emulsion stability,
2. no crystallisation in the layer,
3. diffusion stability,
4. low layer loading.

It has now been found that these objects may be achieved with a compound of the formula (I).

The present invention accordingly provides a photographic material having at least one photosensitive silver halide emulsion layer and at least one non-photosensitive layer on a support, which material contains at least one compound of the formula (I) in at least one of the layers,

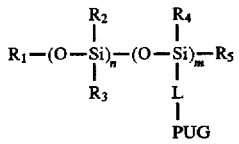

(I)

in which $R^1$ means H, alkyl, $Si(CH_3)_3$ or, together with $R_5$, a direct bond, $R_2$,$R_4$ means hydroxy, alkoxy, alkyl, phenyl, $OSi(CH_3)_3$ or $—OSi(OR_6)$, $R_3$ means alkyl, aryl or alkenyl, $R_5$ means OH, alkoxy, $—OSi(CH_3)_3$ or, together with $R_1$, a direct bond, $R_6$ means alkyl, L means a divalent linking member, PUG means a photographically active group, n means 0 to 100 and m means 2 to 100.

Substituents having the same designation (for example $R_2$) in a polymer may be identical or different.

$R_1$ is preferably H or $Si(CH_3)_3$, $R_2$ and $R_4$ are preferably $CH_3$, $R_3$ is preferably alkyl, $R_5$ is preferably OH or $OSi(CH_3)_3$, $R_6$ is preferably $C_1$–$C_4$ alkyl, L is preferably $—(L_a)—(L_b)_r—(CH_2)_s—(L_c)_t—(L_d)_u—(L_e)_v—$, r, s, t, u, v are 0 or 1, $L_a$ is alkylene, $L_b$ is arylene, $L_c$ is —O— or $—NR_7—$, $L_d$ is —CO—, $L_e$ is alkylene, arylene or aralkylene and $R_7$ is H, alkyl or aryl, wherein $L_a$ is $—CH_2—CR_8R_9$ if r is 1 and s is 0 if r is 0 and $R_8$, $R_9$ mean H or $CH_3$.

L particularly preferably has the following meanings:

$$-CH_2-CH_2-L_b-L_h-,$$

$$-(CH_2)_o-O-CH_2-\underset{\underset{OH}{|}}{(CH)_p}-CH_2-O-(CO)_q-$$

$$-(CH_2)_o-L_f-L_e-L_g- \quad \text{or} \quad -(CH_2)_o-O-,$$

wherein o means an integer greater than 2, in particular 3, p means 0 or 1 q means 0 or 1

$L_f$ means —O—, —OCO— or —O—CO—NH—, $L_g$ means —O—, —CO— or —O—CO— and $L_h$ means —O—, $—NR_3—$, —OCO or —NH—CO—.

Examples of the residue -L-PUG are:

$-(CH_2)_3-O-PUG$, $-(CH_2)_3-OCO-PUG$,

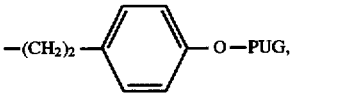

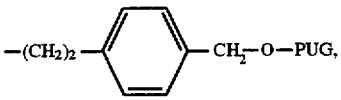

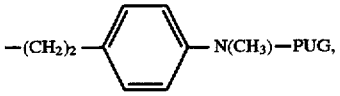

$-(CH_2)_3-O-CH_2-CH_2-OCO-PUG$,
$-(CH_2)_3-OCO-CH_2-CH_2-PUG$,
$-(CH_2)_3-OCO-CH_2-CH_2-COO-PUG$ and
$-(CH_2)_3-OCO-(CH_2)_4-CONH-PUG$.

Examples of the residue $R_3$ are $CH_2=CH-$, $CH_3$, $C_6H_{13}$, $C_8H_{17}$, $C_{14}H_{29}$, phenyl, 2-phenylethyl, butoxyethyl, $HO-(CH_2-CH_2-O)_4-CH_2-CH_2-CH_2-$,

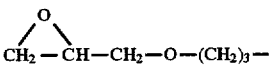

$HO-(CH_2-CH_2-O)_{10}-(CH_2)_3-$,
$HO-(CH_2-CH_2-O)_{16}-(CH_2)_3-$.

Examples or $R_1$ are:

—H, $—Si(CH_3)_3$, $—CH_2—CH_2—CH_2—COOH$, $—(CH_2—CH_2—O)_6—CH_3$.

Examples of $R_5$ are:

—OH, $—OSi(CH_3)_3$, $—O—(CH_2)_3—COOH$, $—O—(CH_2—CH_2—O)_6—CH_3$.

The photographically active group PUG imparts the properties of the following photographically active compounds to the compounds of the formula (I) according to the invention. Literature references disclosing classes of compounds of the various photographically active compounds are also shown.

(a) Dye stabilisers to improve stability on storage in the light and darkness, *Res. Discl.* 37 254, part 8 (1995), *Res. Discl.* 37 038, parts V, VI and VII (1995);

(b) UV absorbers, *Res. Discl.* 37 254, part 8 (1995), *Res. Discl.* 37 038, part X (1995);

(c) Scavengers (DOP scavengers, white couplers, colour developer scavengers), *Res. Discl.* 37 254, part 7 (1995), *Res. Discl.*, parts III, IV and VII (1995);

(d) Filter dyes, *Res. Discl.* 37 254, part 8 (1995), *Res. Discl.* 37 038, part XIII (1995);

(e) Colour couplers and masking couplers, *Res. Discl.* 37 254, part 4 (1995), *Ris. Discl.* 37 038, part II (1995);

(f) Couplers which eliminate photographically active groups, for example DIR couplers, *Res. Discl.* 37 254, part 5 (1995), *Res. Discl.* 37 038, part XIV (1995).

The compounds of the formula (I) may contain one or more different PUG groups in a single molecule.

Preferred dye stabilising groups are:

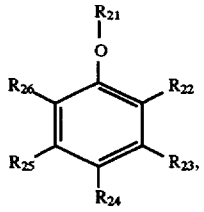

(II)

wherein $R_{21}$ means H, alkyl, aryl, acyl, alkenyl, $R_{22}$ to $R_{26}$ mean H, alkyl, alkenyl, aryl, acyl, acylamino, acyloxy, alkoxy, aryloxy, halogen, —COOH, —$SO_3H$, cyano, —$N(R_{27})R_{28}$, $R_{27,28}$ mean H, alkyl, aryl, $R_{24}$ is not H if $R_{21}$ is H or acyl and adjacent residues $R_{21}$ to $R_{28}$ may also form a 5- to 8-membered ring.

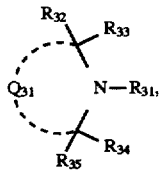

(III)

wherein $R_{31}$ means H, alkyl, aryl, acyl, alkenyl, $R_{32}$ to $R_{35}$ mean H, alkyl, aryl, alkenyl, acyl, $Q_{31}$ means a group to complete a 5- to 8-membered ring, preferably,

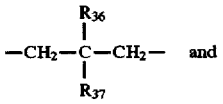

and $R_{36}$ and $R_{37}$ have the meaning of $R_{22}$.

$R_{41}$—S—$R_{42}$ (IV), in which $R_{41}$, $R_{42}$ mean alkyl, aryl, alkenyl and $R_{41}$ and $R_{42}$ may form a 5- to 8-membered ring.

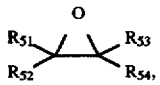

(V)

in which $R_{51}$, $R_{52}$, $R_{53}$, $R_{54}$ mean H, alkyl, aryl, alkenyl, acyl, cyano, —COOH, —$SO_3H$, preferably H, alkyl, aryl, acyl and two residues $R_{51}$ to $R_{54}$ may form a 5- to 8-membered ring and one of the residues $R_{51}$ to $R_{54}$ is not H.

Preferred UV absorbing compounds are:

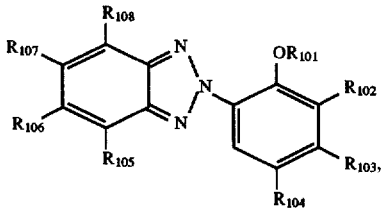

(VI)

in which $R_{101}$ means H or an alkali-labile group, $R_{104}$ means alkyl, aryl, alkyl, alkoxy, aryloxy, alkylthio, arylthio, acyl, acylamino or acyloxy, $R_{102}$, $R_{103}$ mean H or $R_{104}$, $R_{105}$ to $R_{108}$ mean $R_{104}$, H or halogen.

Preferably, $R_{101}$ is H, $R_{102}$ is H or alkyl, $R_{103}$, $R_{105}$, $R_{108}$ are H, $R_{104}$ is alkyl, $R_{106}$ is H or alkoxy and $R_{107}$ is H, alkoxy or halogen.

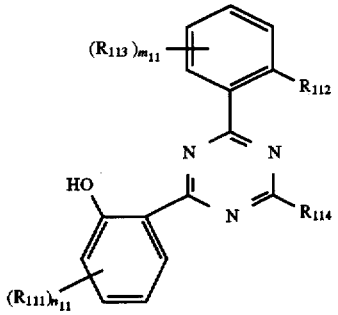

(VII)

in which $R_{111}$, $R_{113}$ mean halogen, OH, SH, alkyl, aryl, alkoxy, aryloxy, acyloxy, acylamino, acyl, $N(R_{115})R_{116}$, alkylthio or arylthio, $R_{112}$ means H, OH, halogen, alkyl, $R_{114}$ means alkyl, alkoxy, aryloxy, alkylthio, arylthio or

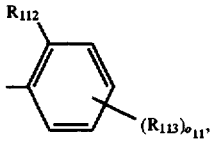

$R_{115}$, $R_{116}$ mean H, alkyl, aryl, $m_{11}$, $n_{11}$, $o_{11}$ mean 0, 1, 2, 3, 4 and two or more residues $R_{111}$, $R_{113}$ may be identical or different.

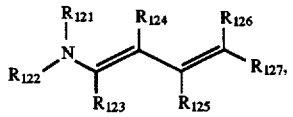

(VIII)

in which $R_{121}$, $R_{122}$ mean alkyl or aryl, $R_{123}$ means H, alkyl, alkoxy or aryloxy, $R_{124}$, $R_{125}$ mean H or alkyl, $R_{126}$ means CN or acyl, $R_{127}$ means H, alkyl or $R_{126}$ and adjacent residues $R_{121}$ to $R_{127}$ may form a 5- to 8-membered ring.

Preferred DOP scavenger compounds are:

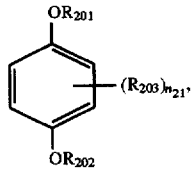

(IX)

in which $n_{21}$ means 1, 2, 3, 4, $R_{201}$, $R_{202}$ mean H or an alkali-labile group, $R_{203}$ means alkyl, aryl, alkenyl, acyl, alkoxy, acylamino, nitro, $N(R_{204})R_{205}$, COOH, $SO_3H$, halogen or cyano, $R_{204}$, $R_{205}$ mean H, alkyl, aryl or alkenyl and adjacent residues $R_{201}$ to $R_{205}$ may form a 5- to 8-membered ring and two or more residues $R_{203}$ may be identical or different.

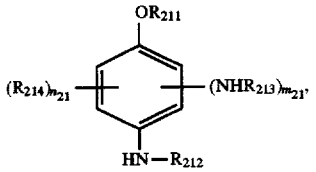

(X)

in which $m_{21}$ means 0, 1, $n_{21}$ means 0, 1, 2, 3, $R_{211}$ means H or an alkali-labile group, $R_{212}$, $R_{213}$ mean acyl, $R_{214}$ means alkyl, aryl, alkenyl, acyl, —$OR_{211}$, alkoxy, aryloxy, halogen, COOH or $SO_3H$ and wherein two or more residues $R_{214}$ may be identical or different.

$$R_{231}—X_{221} \quad \text{(XI)},$$

in which $R_{231}$ means alkyl, alkenyl, aryl or heterocyclyl, $X_{221}$ means $SO_2M$, SH, —$N(R_{222})_2$, M means H, alkali metal, acylhydrazo, $N(R_{223})_4^{\oplus}$, $(R_{224})_2C{=}N{-}NH$ and $R_{222}$, $R_{223}$, $R_{224}$ are identical or different and mean alkyl or two residues $R_{222}$ to $R_{224}$ may form a ring.

Preferred colour developer scavengers are:

$$R_{301}—(L_{301}—L_{302})_{m30}—X_{301} \quad \text{(XII)},$$

in which $R_{301}$ has the meaning of $R_{231}$, $L_{301}$ means a single bond, alkylene, —O—,—S— or —$NR_{302}$, $L_{302}$ means $$-CO-,\ -SO,\ -SO_2,\ -CS-,\ -\overset{\overset{\displaystyle O}{\|}}{\underset{\underset{\displaystyle OH}{|}}{P}}-,$$

$$-C{=}(NR_{303})- \quad \text{or} \quad -Si(R_{304})(R_{305})-,$$

$R_{302}$ means H or alkyl, $R_{303}$, $R_{304}$, $R_{305}$ means alkyl $X_{301}$ means aryloxy, alkyloxy, heterocyclyloxy, alkylthio, arylthio, heterocyclylthio or halogen and $m_{30}$ means O if $X_{301}$ is halogen, otherwise 1.

Preferred colour couples are:

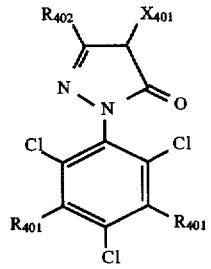

(XIII)

wherein $R_{401}$ means H, Cl, $R_{402}$ means alkylcarbonylamino, arylcarbonylamino, anilino and $X_{401}$ means H, Cl, a nitrogen containing heterocycle linked via the N-atom e.g. pyrazolo; arylthio, alkylthio, aryloxy;

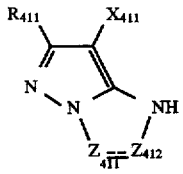

(XIV)

wherein $R_{411}$ means alkyl, aryl $Z_{411}$ means —N= and $Z_{412}$—$C(R_{412})$= or $Z_{411}$ means —$(C(R_{412})$= and $Z_{412}$—N=

$R_{412}$ means alkyl, aryl and $X_{411}$ means H, Cl, aryloxy; a nitrogen containing heterocycle linked via the N atom e.g. pyrazolo; alkylthio, arylthio;

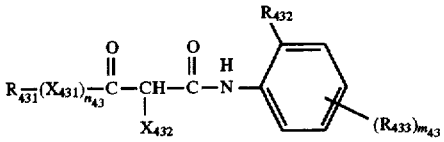

(XV)

wherein $R_{431}$ means alkyl, aryl, $R_{432}$ means alkoxy, halogen, aryloxy, $R_{433}$ means acyl, acylamino, alkyl, aryl, alkoxy, halogen, $X_{431}$ means —$N(R_{431})$—

$X_{432}$ means a nitrogen containing heterocycle linked via the N atom, $n_{43}$ means 0,1 and $m_{43}$ means 1,2 and wherein two radicals $R_{431}$ can form a five to seven membered ring;

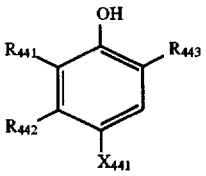

(XVI)

wherein $R_{441}$ means H, Cl, alkoxy, $R_{442}$ means alkyl, acylamino, $R_{443}$ means H, acylamino and $X_{441}$ means H, Cl, acyloxy, alkoxy, aryloxy, alkylthio, arylthio or $R_{441}$ and $R_{442}$ may form an anellated, optional substituted benzene or oxazole ring.

Alkyl residues may be linear, branched or cyclic as well as optionally substituted. Aryl residues may be substituted. Acyl residues are derived from aliphatic, olefinic, aromatic or heterocyclic carboxylic, carbonic, carbamic, sulphonic, amidosulphonic, phosphoric or phosphonic acids.

The compounds of the formulae (II) to (XVI) are attached to the polysiloxane skeleton via one of their substituents and the group L.

The compounds according to the invention of the formula (I) may be produced using the process described in EP 480 466 or by known polymer-analogous processes.

The sum of n and m is in particular 4 to 50, preferably 4 to 30 in open-chain compounds of the formula (I), and 3 to 7 in cyclic compounds.

Examples of compounds according to the invention are those of the following formulae, wherein

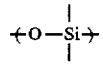

indicates that the groups placed between brackets are present in multiple instances in accordance with the (weight average) molecular weight $\overline{M}_w$. Where two or more different monomers are used, polymer structure is random.

(I-1)

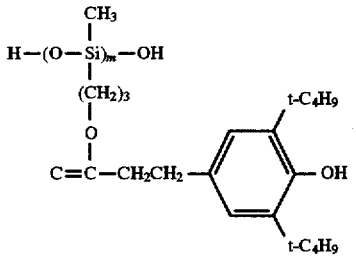

$\overline{M}_w = 5000$ (I-2)

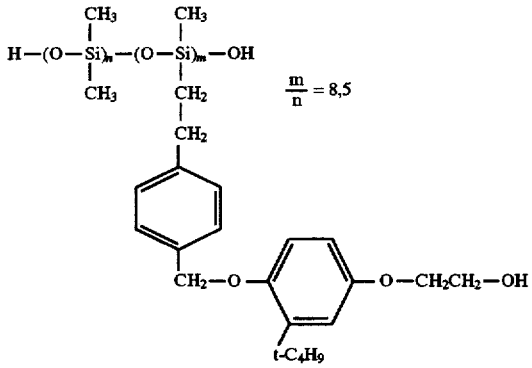

$\overline{M}_w = 3500$ (I-3)

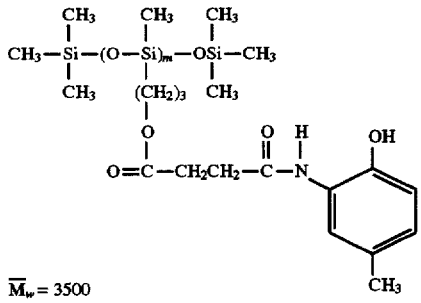

$\overline{M}_w = 3500$

-continued
(I-4)
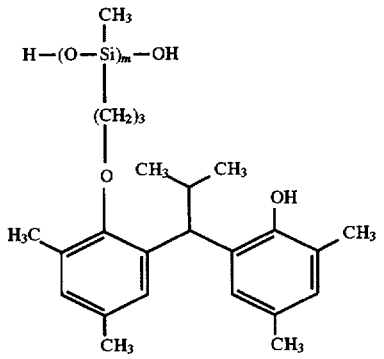
$\overline{M}_w = 4500$
(I-5)
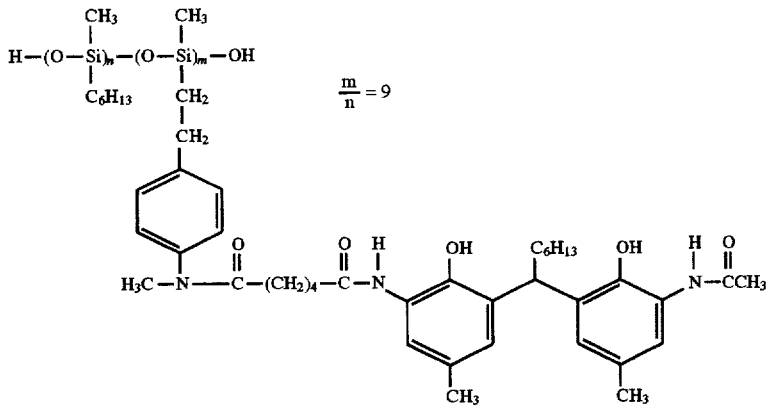
$\frac{m}{n} = 9$
$\overline{M}_w = 5000$
(I-6)
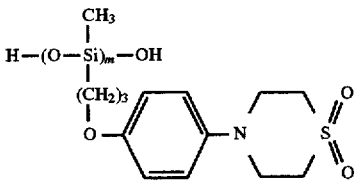
$\overline{M}_w = 3800$
(I-7)
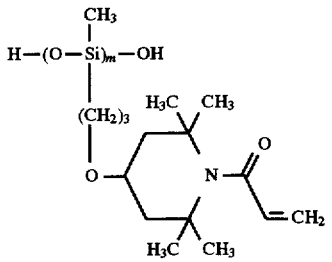
$\overline{M}_w = 4300$ -continued
(I-8)
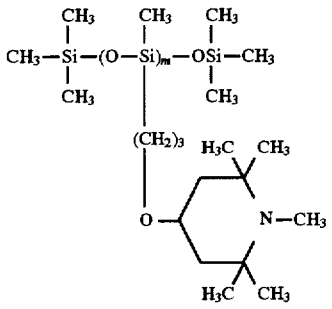
$\overline{M}_w = 3500$
(I-9)
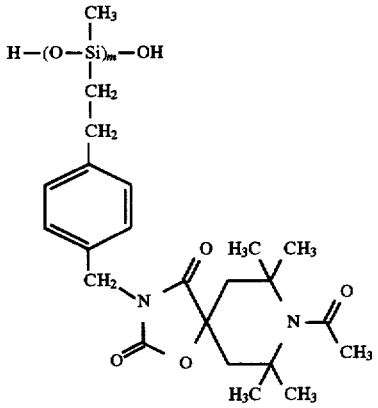
$\overline{M}_w = 5000$
(I-10)
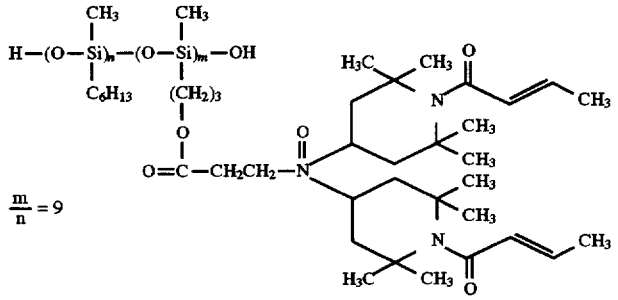
$\frac{m}{n} = 9$
$\overline{M}_w = 5500$
(I-11)
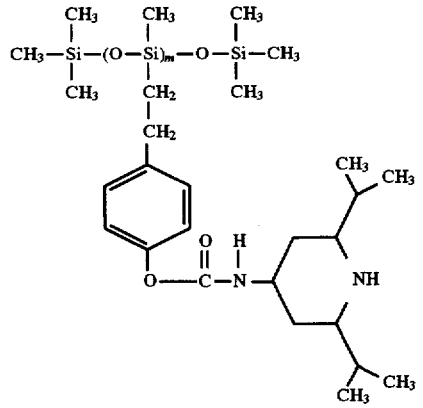
$\overline{M}_w = 4000$ -continued
(I-12)
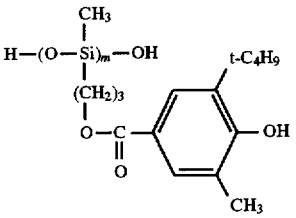
$\overline{M}_w = 3800$
(I-13)
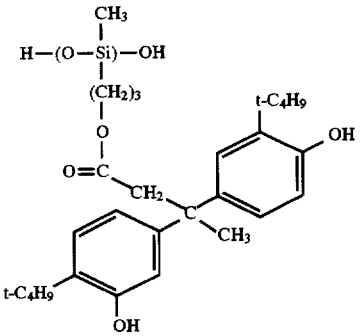
$\overline{M}_w = 4200$
(I-14)
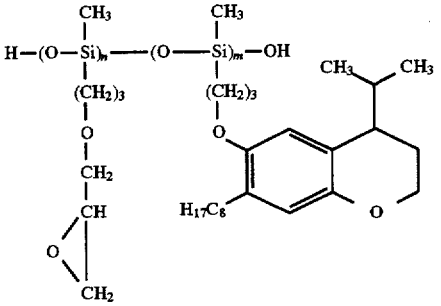
$\frac{m}{n} = 9$
$\overline{M}_w = 4500$
(I-15)
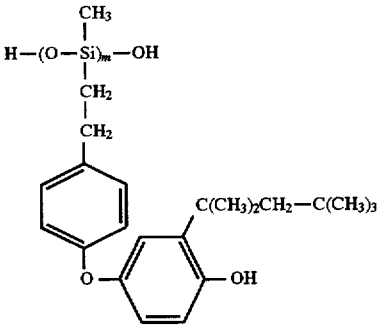
$\overline{M}_w = 4000$
(I-16)
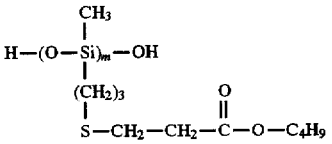
$\overline{M}_w = 3500$ -continued
(I-17)
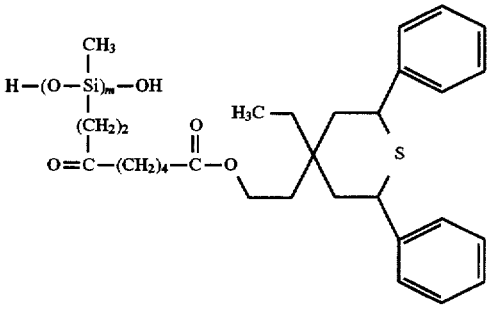
$\overline{M}_w = 4300$
(I-18)
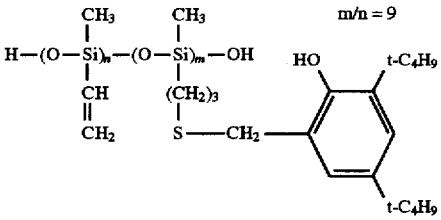
$\overline{M}_w = 3500$
(I-19)
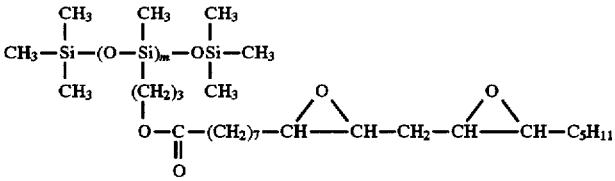
$\overline{M}_w = 3500$
(I-20)
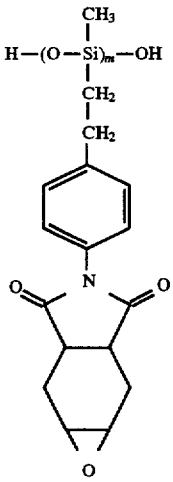
$\overline{M}_w = 4000$ -continued
(I-21)
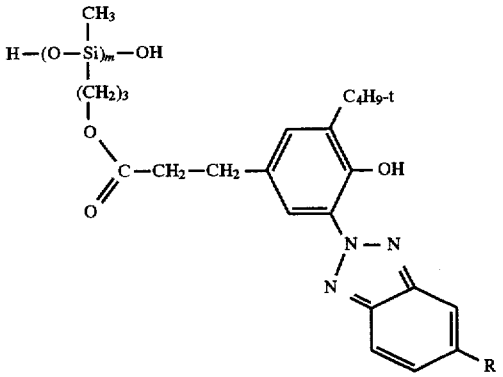
R = Cl
$\overline{M}_w$ = 7000
(I-22)
R = H
$\overline{M}_w$ = 6800
(I-23)
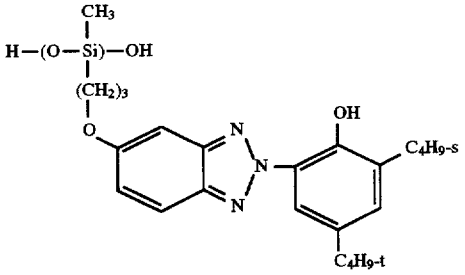
$\overline{M}_w$ = 6100
(I-24)
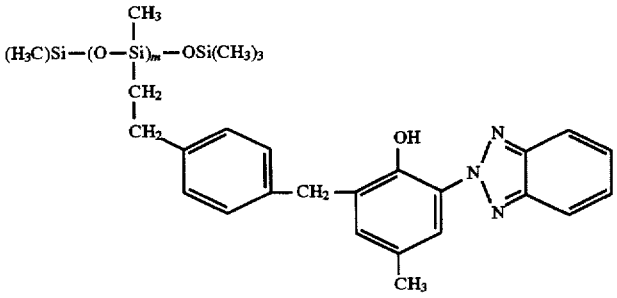
$\overline{M}_w$ = 5300
(I-25)
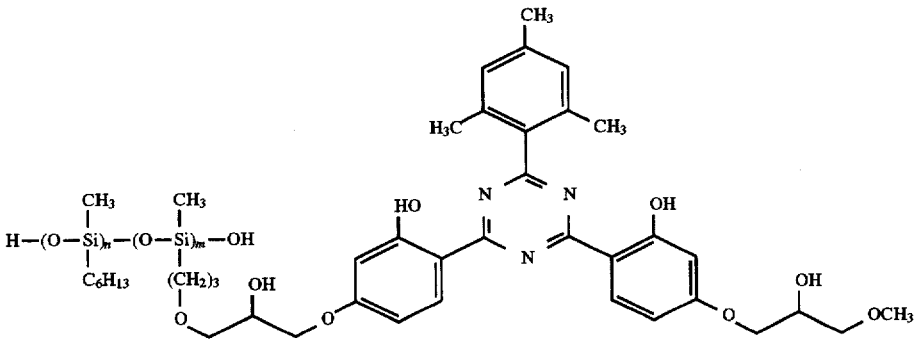
$\overline{M}_w$ = 8200
n/m = 1:4

-continued
(I-26)
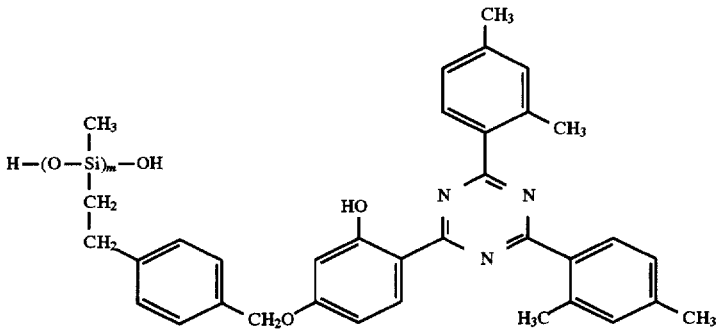
$\overline{M}_w = 5700$
(I-27)
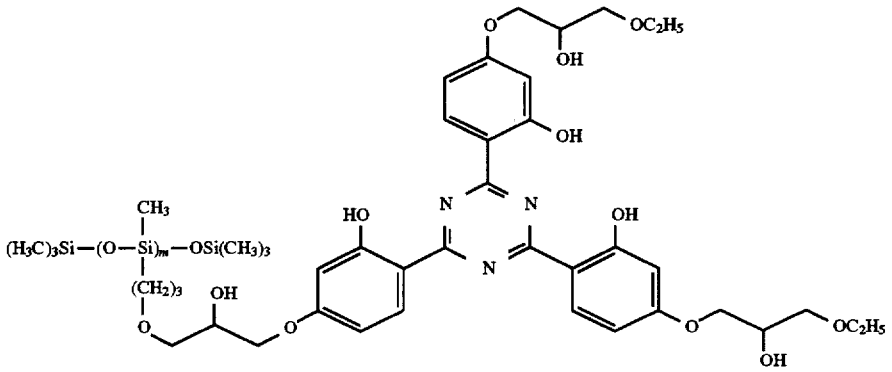
$\overline{M}_w = 6100$
(I-28)
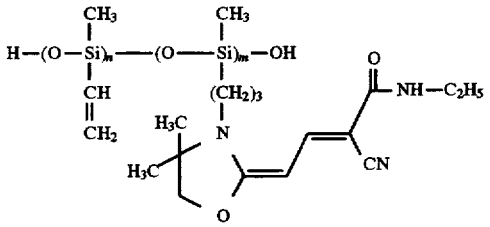
$\overline{M}_w = 4600$
n/m = 1:9
(I-29)
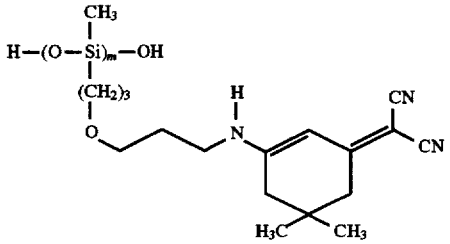
$\overline{M}_w = 3400$
(I-30)
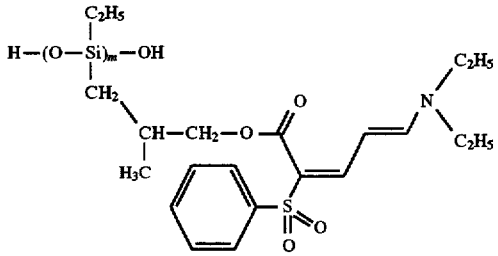
$\overline{M}_w = 4100$ -continued
(I-31)
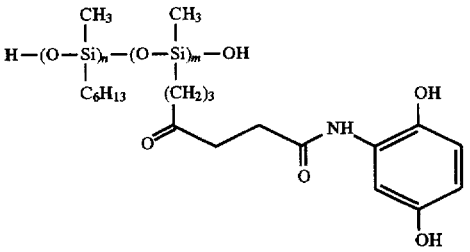
$\overline{M}_w = 5100$
n/m = 1:4
(I-32)
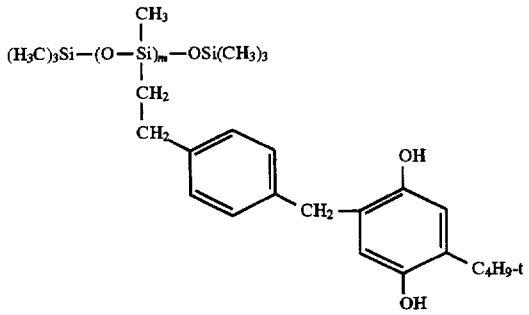
$\overline{M}_w = 3400$
(I-33)
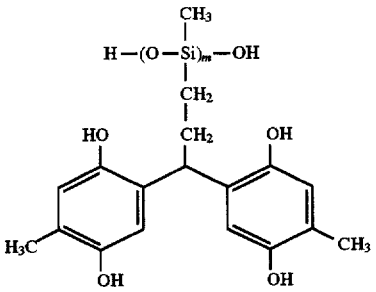
$\overline{M}_w = 4400$
(I-34)
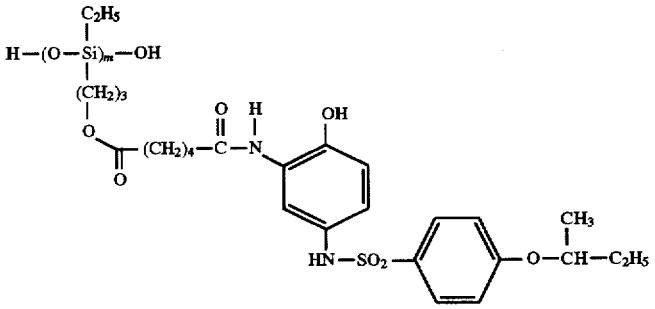
$\overline{M}_w = 6000$ -continued
(I-35)
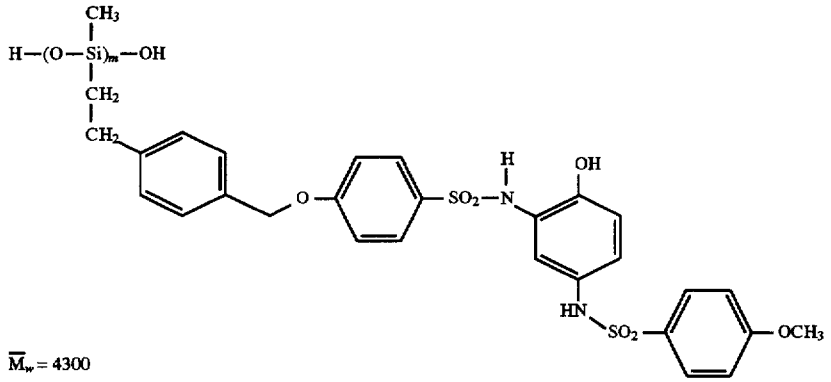
$\overline{M}_w = 4300$
(I-36)
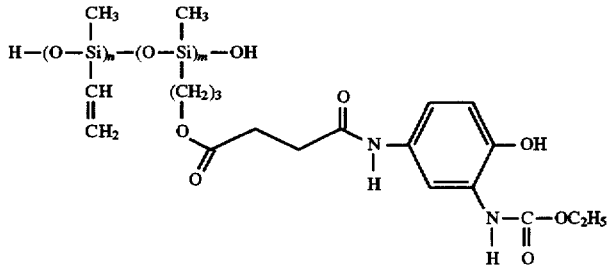
$\overline{M}_w = 5000$
n/m = 1:9
(I-37)
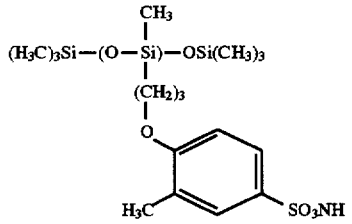
$\overline{M}_w = 2800$
(I-38)
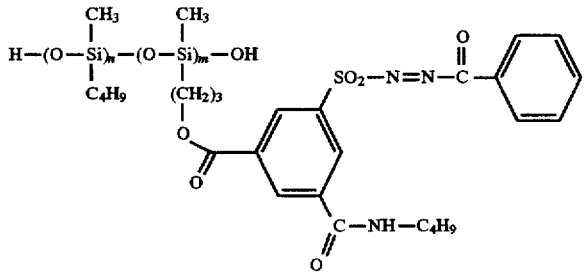
$\overline{M}_w = 4800$
(I-39)
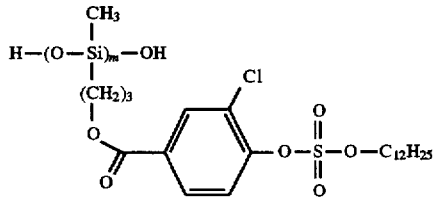
$\overline{M}_w = 3900$ -continued
(I-40)
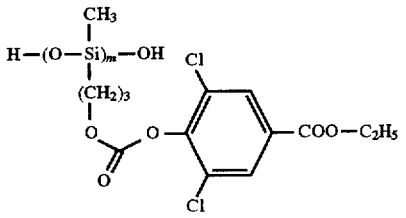
$\overline{M}_w = 5500$
(I-41)
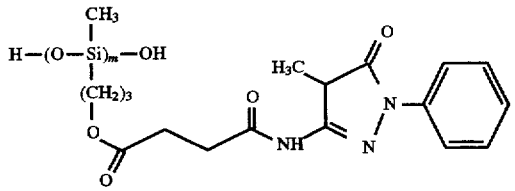
$\overline{M}_w = 8600$
(I-42)
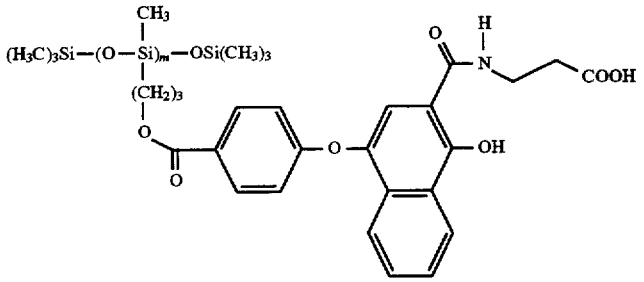
$\overline{M}_w = 4800$
(I-43)
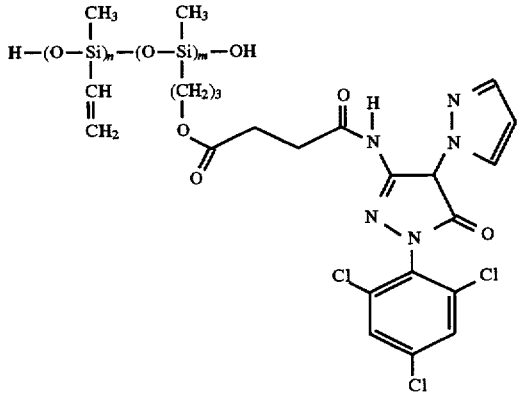
$\overline{M}_w = 6100$
n/m = 1:3

-continued
(I-44)
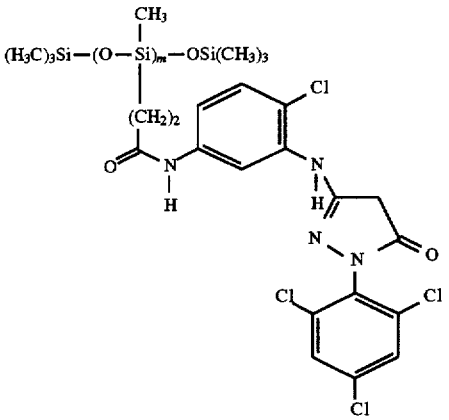
$\overline{M}_w = 5200$
(I-45)
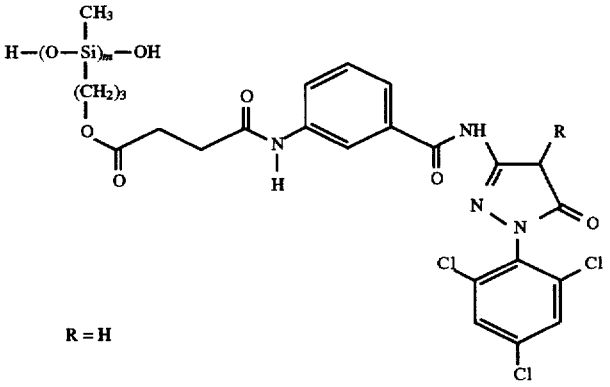
R = H
$\overline{M}_w = 4600$
(I-46)
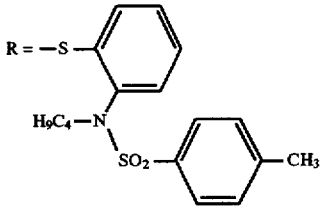
$\overline{M}_w = 5900$
(I-47)
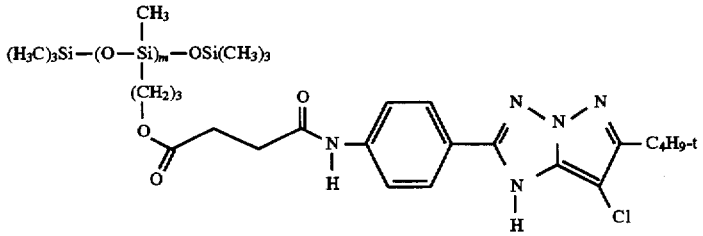
$\overline{M}_w = 5000$ -continued
(I-48)
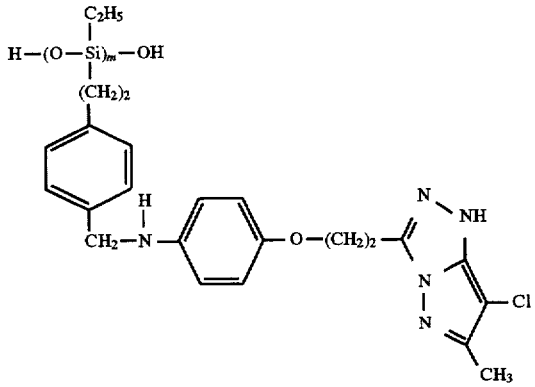
$\overline{M}_w = 8100$
(I-49)
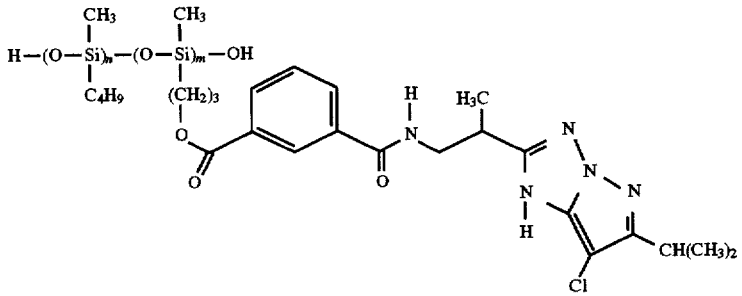
$\overline{M}_w = 6200$
n/m = 2:7
(I-50)
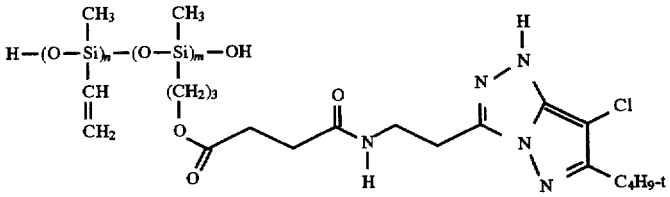
$\overline{M}_w = 4800$
n/m = 1:4
(I-51)
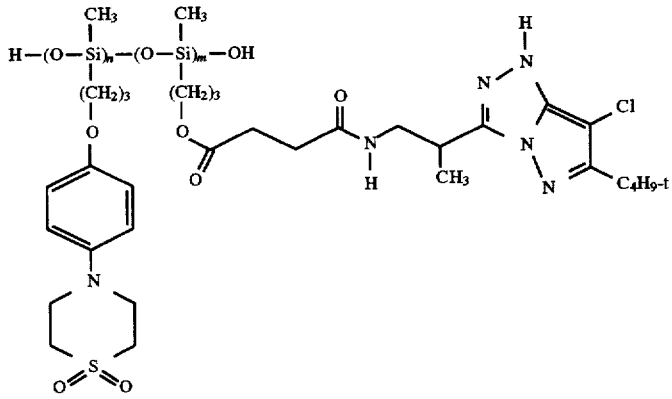
$\overline{M}_w = 5900$
n/m = 1:1

-continued
(I-52)
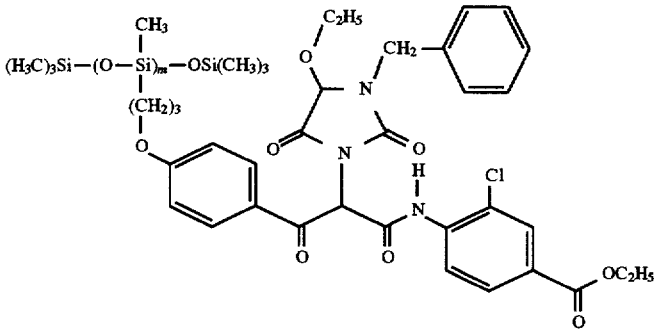
$\overline{M}_w = 4700$
(I-53)
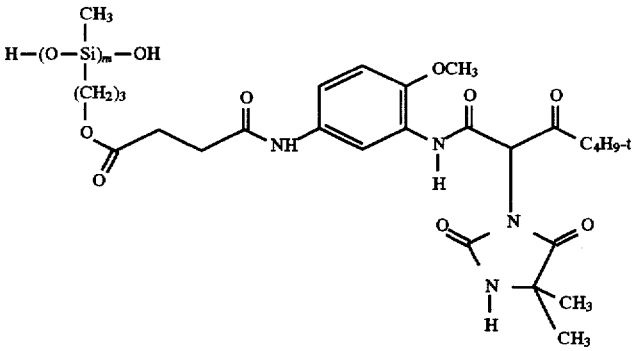
$\overline{M}_w = 6000$
(I-54)
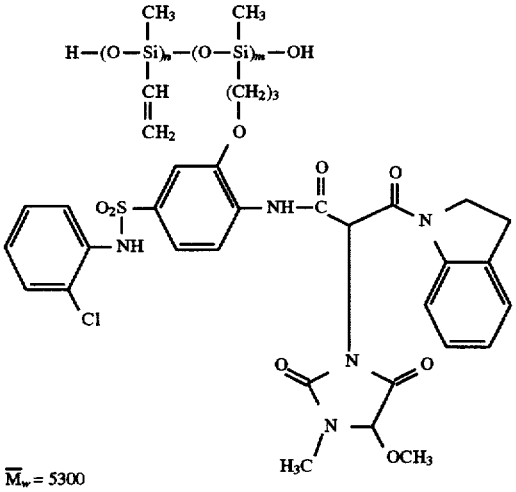
$\overline{M}_w = 5300$
n/m = 1:5
(I-55)
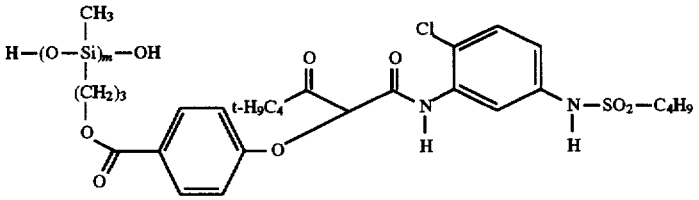
$\overline{M}_w = 4100$ -continued
(I-56)
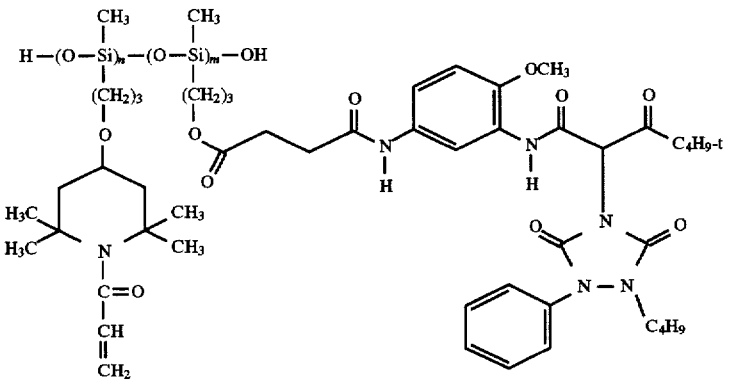
$\overline{M}_w$ = 6200
n/m = 1:5
(I-57)
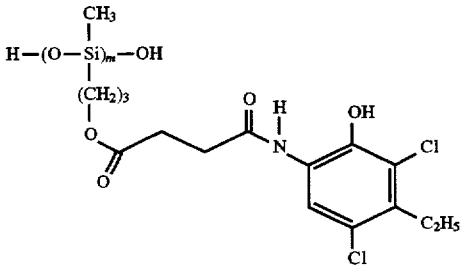
$\overline{M}_w$ = 3800
(I-58)
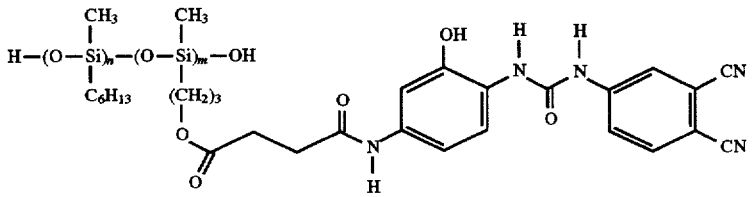
$\overline{M}_w$ = 5400
n/m = 1:9
(I-59)
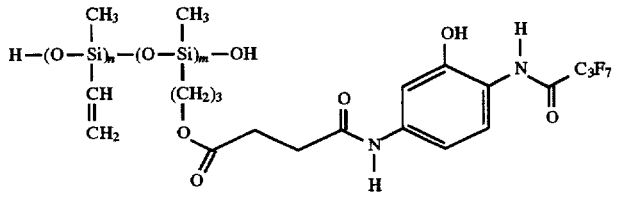
$\overline{M}_w$ = 5500
n/m = 1:7
(I-60)
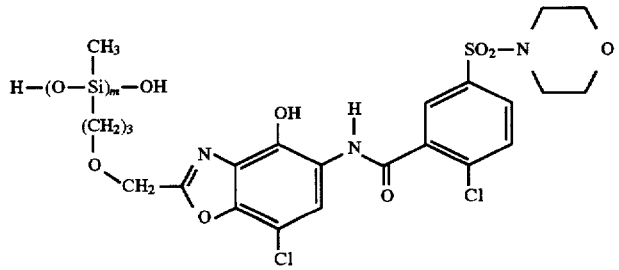
$\overline{M}_w$ = 4400

-continued
(I-61)
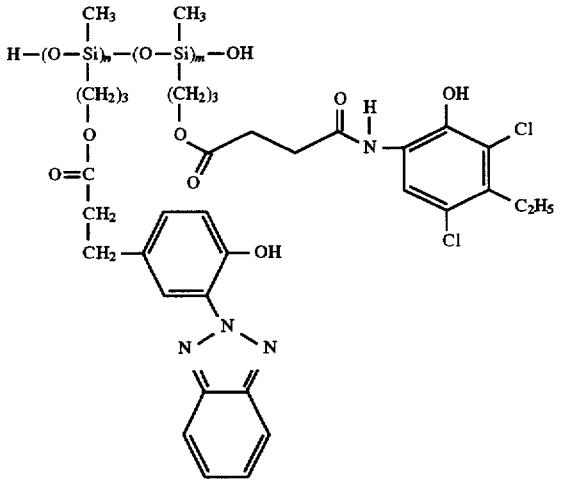
$\overline{M}_w = 6700$
n/m = 1:2
(I-62)
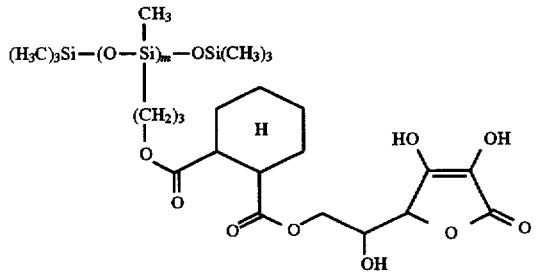
$\overline{M}_w = 3700$
(I-63)
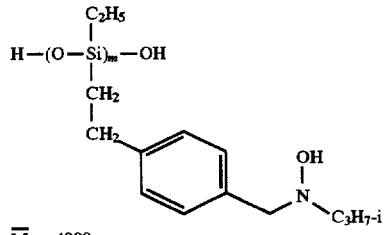
$\overline{M}_w = 4000$
(I-64)
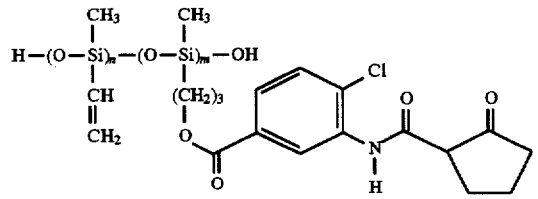
$\overline{M}_w = 4300$
n/m = 1:6
(I-65)
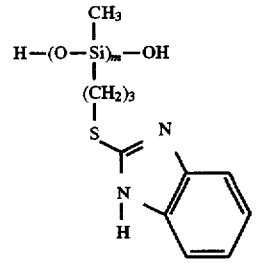
$\overline{M}_w = 3000$ -continued
(I-66)
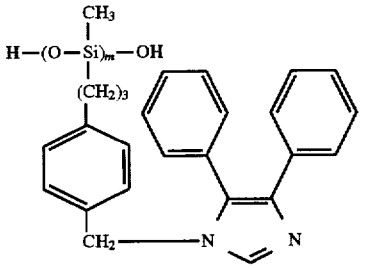
$\overline{M}_w = 3400$
(I-67)
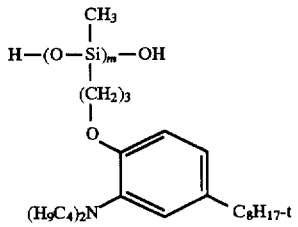
$\overline{M}_w = 5100$
(I-68)
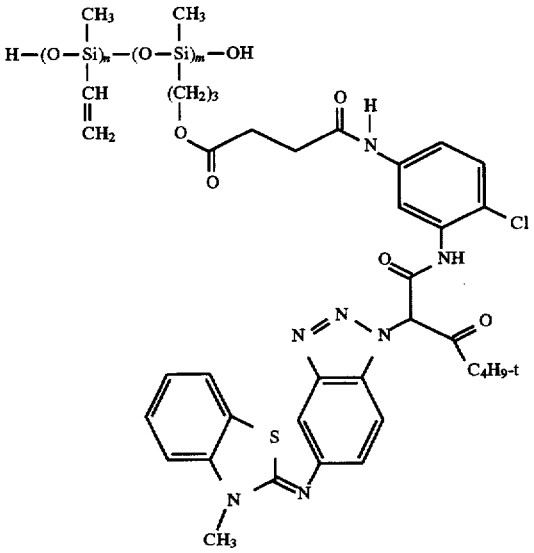
$\overline{M}_w = 4700$
n/m = 1:5

-continued
(I-69)
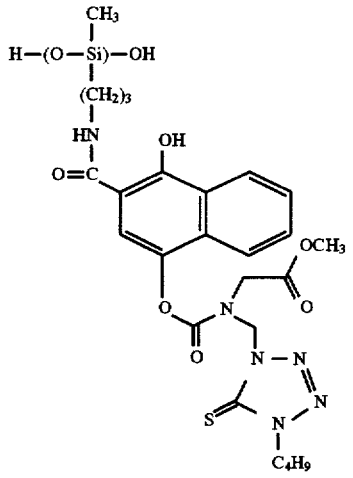
$\overline{M}_w = 3900$
(I-70)
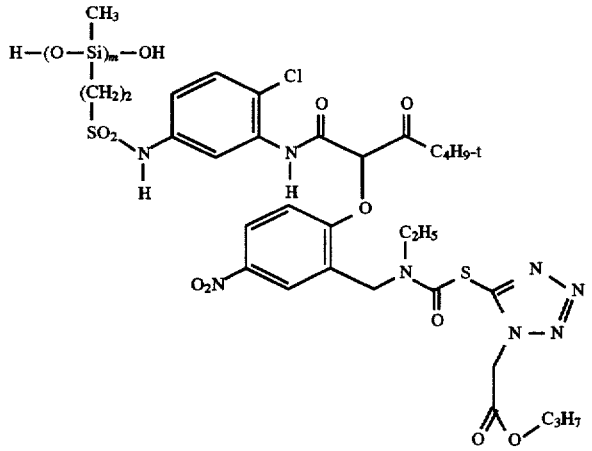
$\overline{M}_w = 5600$
(I-71)
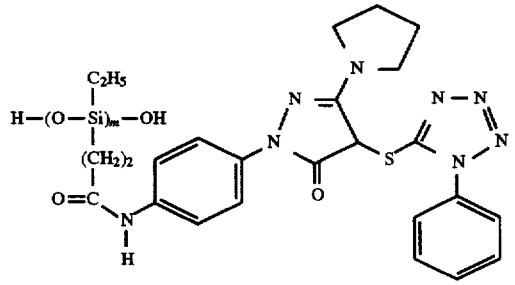
$\overline{M}_w = 4900$ -continued
(I-72)
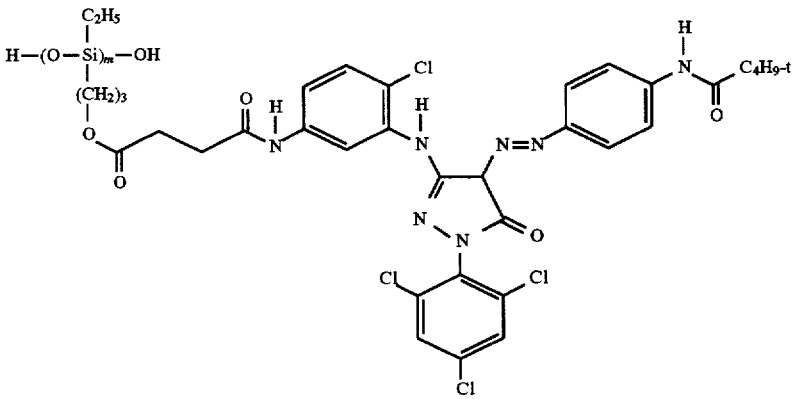
$\overline{M}_w = 6300$
(I-73)
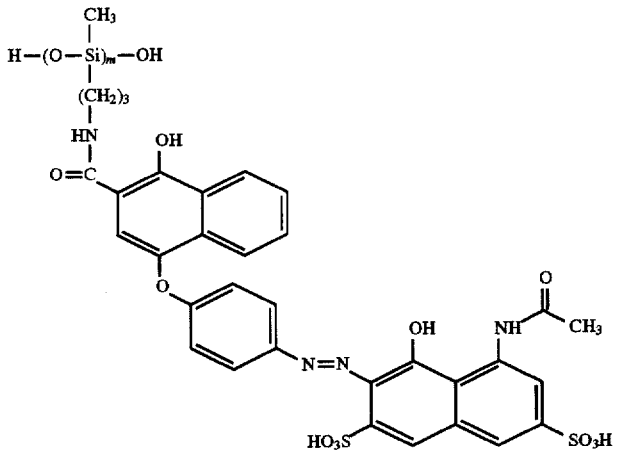
$\overline{M}_w = 4400$
(I-74)
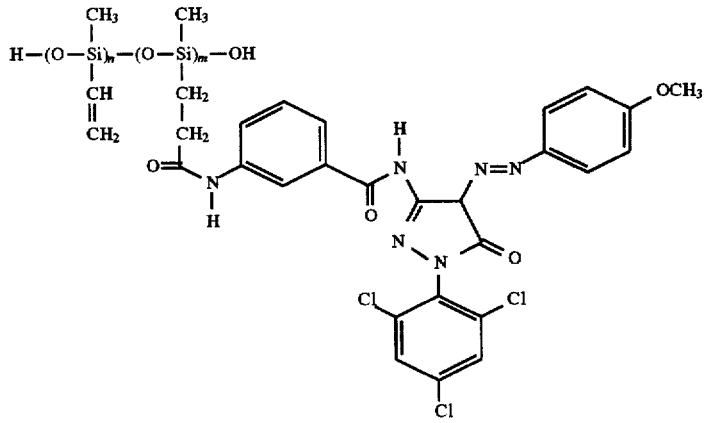
$\overline{M}_w = 5200$
n/m = 1:7

-continued
(I-75)
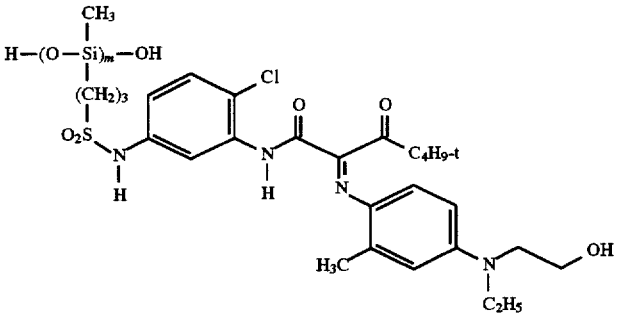
$\overline{M}_w$ = 3800
(I-76)
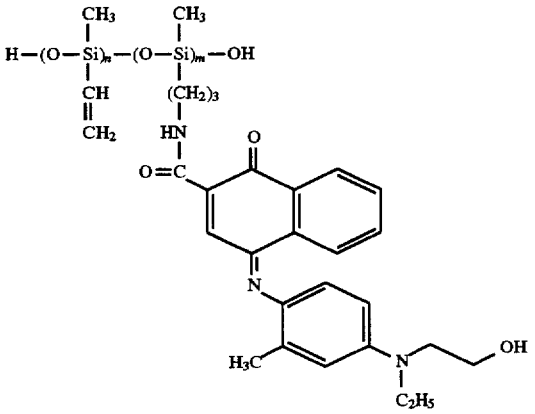
$\overline{M}_w$ = 5000
n/m = 1:4
(I-77)
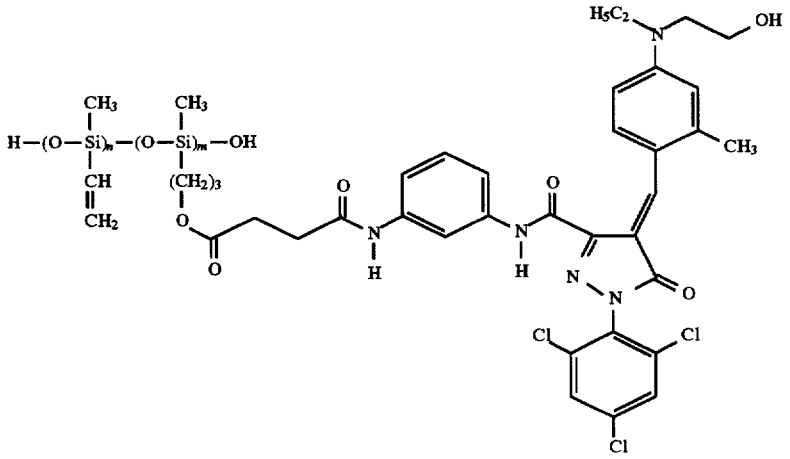
$\overline{M}_w$ = 4800
n/m = 1:9
(I-78)
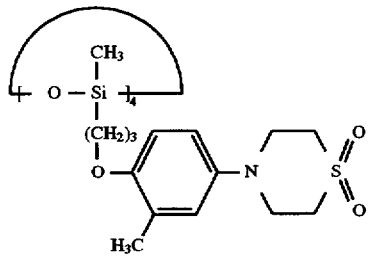

-continued
(I-79)
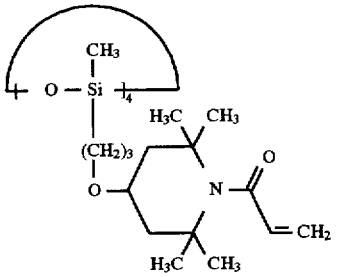
(I-80)
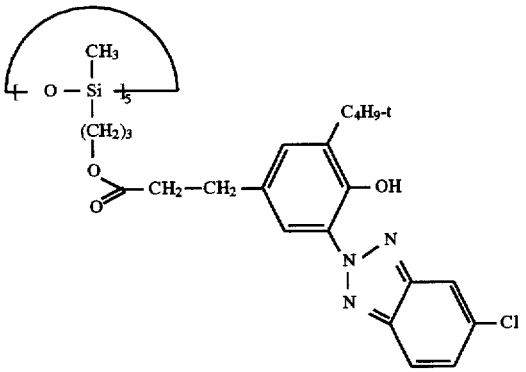
(I-81)
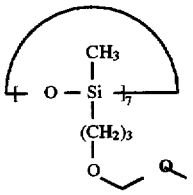
(I-82)
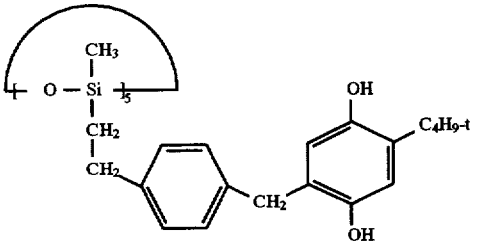
(I-83)
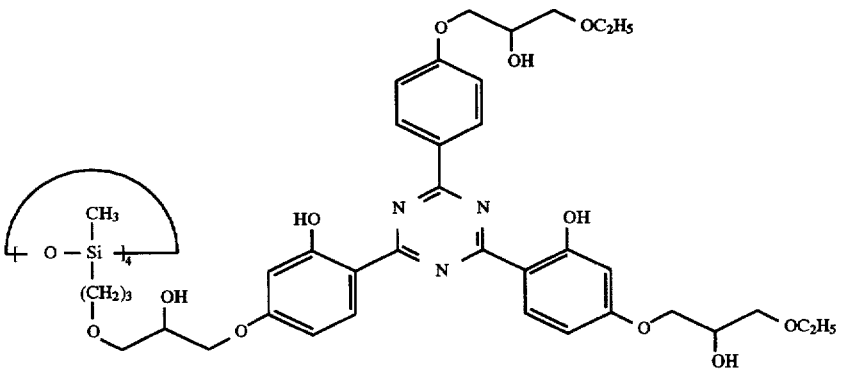

-continued (I-84)

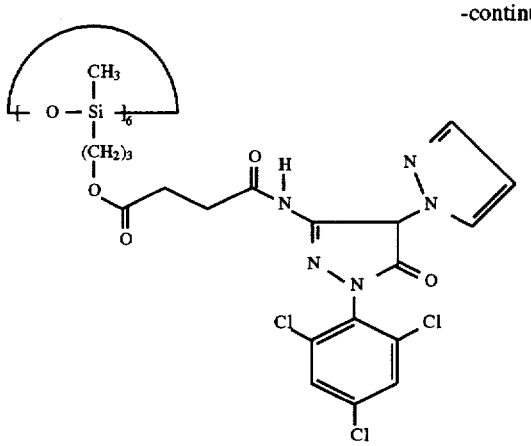

(I-85)

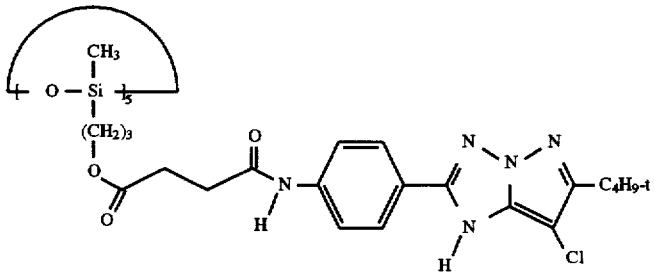

(I-86)

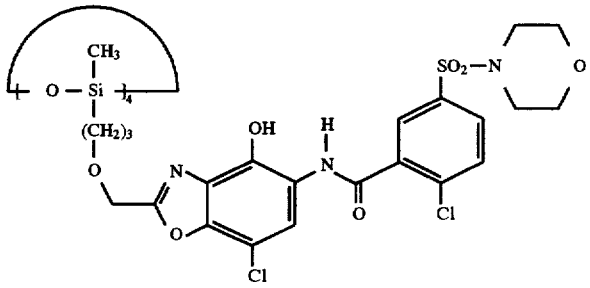

The compound of the formula (I) is used in at least one layer, preferably in a quantity of 0.001 to 5 g/m$^2$ of material, in particular of 0.001 to 2 g/m$^2$ of material.

The compound of the formula (I) is added as a solution or dispersion, for example as a solution in ethyl acetate, to the casting solution for the layer concerned.

The photographic material may be a black-&-white material or a colour photographic material.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 cyan-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers to prevent blue light from reaching the underlying layers.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-A-25 30 645).

Possible options for different layer arrangements and the effects thereof on photographic properties are described in *J. Int. Rec. Mats.*, 1994, volume 22, pages 183–193.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic copying materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 μm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non photosensitive interlayers generally located between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

Sample A 10 g of coupler Y-1 and 5 g of coupler solvent OF-1 are dissolved in 20 g of a low-boiling cosolvent and dispersed in 100 g of 10 wt. % gelatine solution. The emulsion obtained in this manner is subjected to digestion testing in order to determine storage stability. To this end, the emulsion is stored for 5 days at 40° C. and examined after 1 and 5 days. To this end, the emulsion is examined microscopically for the occurrence of crystals, the average particle size is determined by laser correlation spectroscopy and the coarse particle content determined using a Coulter Counter (table 1).

Samples B to M

Samples B to M are produced and tested in the same manner as sample A with the difference that a photographically useful compound (PNV) was added to the emulsion and the coupler and coupler solvent were optionally replaced by the compounds stated in table 1.

Y-1

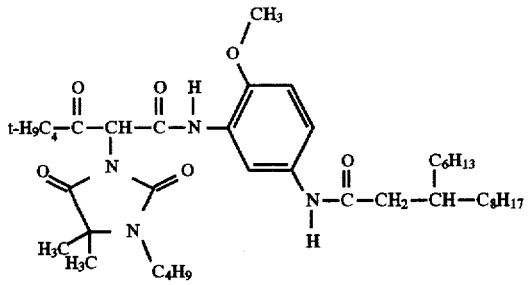

-continued

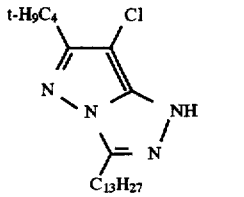

M-1

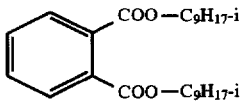

OF-1

1:1 mixture of $H_9C_4-O-\overset{O}{\overset{\|}{C}}-(CH_2)_8-\overset{O}{\overset{\|}{C}}-O-C_4H_9$ and $HO-C_{12}H_{25}$

OF-2

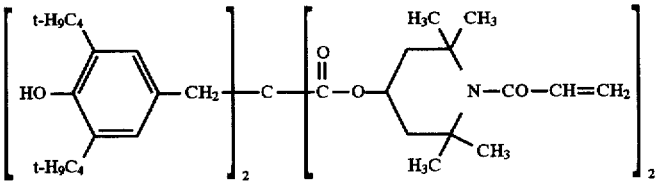

ST-1

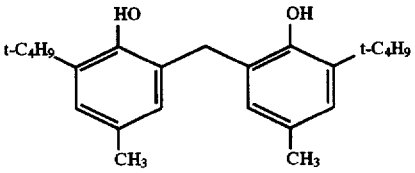

ST-2

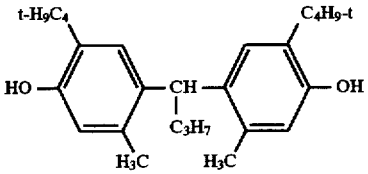

ST-3

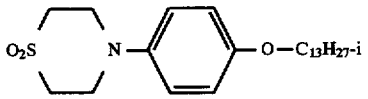

ST-4

TABLE 1

(V: comparison; E: according to the invention; ( ): quantity used in g; K: crystals [–: none; 0: few; +: many]; ΔT: increase in average particle size in %; G: coarse particle loading [number of particles of >5 μm in ppm])

| | | | | after storage for | | | | | |
|---|---|---|---|---|---|---|---|---|---|
| | | Oil | | 1 day | | | 5 days | | |
| Sample | Coupler | former | PNV | K | ΔT | G | K | ΔT | G |
| A (V) | Y-1 | OF-1 (5) | none | – | 8 | <100 | – | 18 | 1000 |
| B (V) | " | OF-1 (3) | ST-1 (2) | – | 16 | <100 | + | 59 | 20000 |
| C (V) | " | " | ST-2 (2) | – | 15 | <100 | 0 | 41 | 10000 |
| D (E) | " | " | I-1 (2) | – | 4 | <100 | – | – | 500 |
| E (E) | " | " | I-4 (2) | – | 4 | <100 | – | – | 500 |
| F (E) | " | " | I-7 (2) | – | 5 | <100 | – | – | 500 |
| G (V) | M-1 | OF-2 (10) | none | – | 5 | <100 | – | 15 | 500 |
| H (V) | " | OF-2 (6) | ST-3 (4) | 0 | 20 | 500 | + | 74 | 20000 |
| I (V) | " | " | ST-4 (4) | – | 17 | <100 | + | 53 | 10000 |
| K (E) | " | " | I-2 (4) | – | 4 | <100 | – | 13 | 500 |
| L (E) | " | " | I-6 (4) | – | 3 | <100 | – | 10 | 500 |
| M (E) | " | " | I-13 (4) | – | 5 | <100 | – | 14 | 500 |

As table 1 shows, the emulsions obtained according to the invention are distinctly more stable.

EXAMPLE 2

A colour photographic recording material suitable for rapid processing was produced by applying the following layers in the stated sequence onto a film base made from paper coated on both sides with polyethylene. The stated quantities relate in each case to 1 $m^2$. The corresponding quantities of $AgNO_3$ are stated for the applied quantity of silver halide.

Layer structure Sample 1

Layer 1: (Substrate layer)
- 0.2 g of gelatine

Layer 2: (Blue-sensitive layer)
- Blue-sensitive silver halide emulsion (99.5 mol. % chloride, 0.5 mol. % bromide, average grain diameter 0.8 μm) prepared from
- 0.53 g of $AgNO_3$ with
- 1.11 g of gelatine
- 0.60 g of yellow coupler Y-2
- 0.15 g of white coupler W-1
- 0.40 g of coupler solvent OF-3

Layer 3: (Protective layer)
- 1.1 g of gelatine
- 0.04 g of 2,4-di-tert.-octylhydroquinone
- 0.04 g of compound SC-1
- 0.04 g of tricresyl phosphate (TCP)

Layer 4: (Green-sensitive layer)
- Green-sensitised silver halide emulsion (99.5 mol. % chloride, 0.5 mol. % bromide, average grain diameter 0.6 μm ) prepared from
- 0.25 g of $AgNO_3$ with
- 0.95 g of gelatine
- 0.20 g of magenta coupler M-2
- 0.15 g of dye stabiliser ST-4
- 0.08 g of dye stabiliser ST-5
- 0.18 g of coupler solvent OF-4
- 0.12 g of coupler solvent OF-5

Layer 5: (UV protective layer)
- 0.75 g of gelatine
- 0.2 g of UV absorber UV-1
- 0.1 g of UV absorber UV-2
- 0.04 g of 2,4-di-tert.-octylhydroquinone
- 0.04 g of compound SC-1
- 0.1 g of coupler solvent OF-6
- 0.04 g of TCP Layer 6: (Red-sensitive layer)
- Red-sensitised silver halide emulsion (99.5 mol. % chloride, 0.5 mol. % bromide, average grain diameter 0.5 μm) prepared from
- 0.30 g of $AgNO_3$ with
- 0.75 g of gelatine
- 0.36 g of cyan coupler C-1
- 0.30 g of TCP
- 0.06 g of dye stabiliser ST-6

Layer 7: (UV protective layer)
- 0.85 g of gelatine
- 0.36 g of UV absorber UV-1
- 0.18 g of UV absorber UV-2
- 0. 18 g of coupler solvent OF-6

Layer 8: (Protective layer)
- 0.9 g of gelatine
- 0.3 o of hardener H-1

The compounds used are of the following formulae:

Y-2

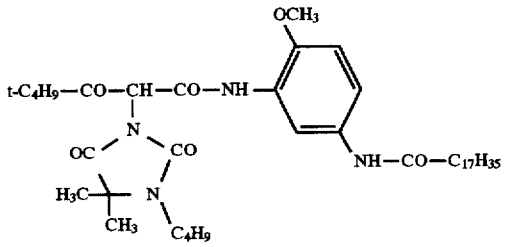

M-2

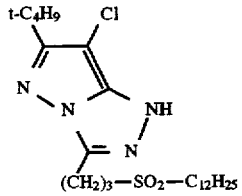

C-1

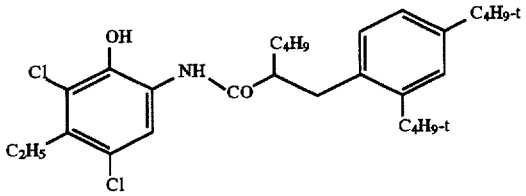

-continued

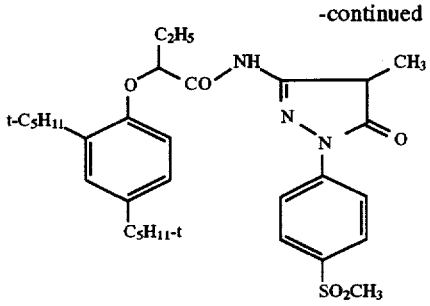

W-1

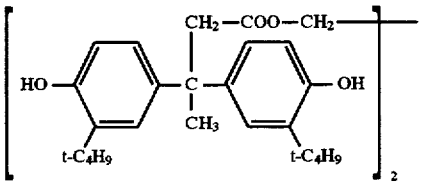

ST-5

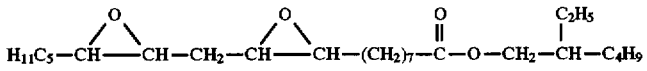

ST-6

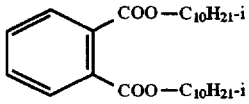

OF-3

$C_4H_9O-CO-(CH_2)_4-CO-OC_4H_9$ OF-4
i-$C_{13}H_{27}-OH$ OF-5
i-$H_{19}C_9OCO-(CH_2)_4-COOC_9H_{19}$-i OF-6

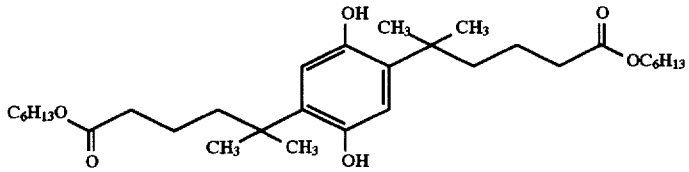

SC-1

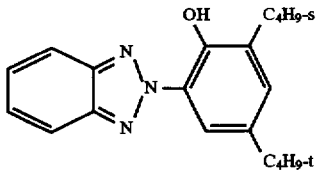

UV-1

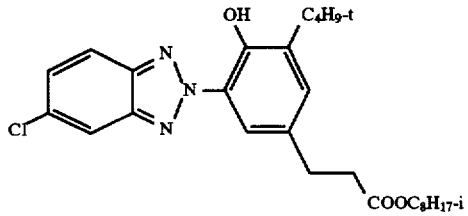

UV-2

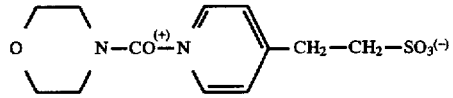

H-1

Samples 2 to 9

Samples 2 to 9 were produced in the same manner as sample 1, with the difference that the quantity of dye stabiliser stated in table 2.1 was additionally added to layer 2 and the corresponding quantity of coupler solvent OF-3 omitted.

The samples are then exposed behind a graduated grey wedge through a U 449 filter and then processed as follows:

a) Colour developer-45 seconds-35° C.

| | |
|---|---|
| Tetraethylene glycol | 20.0 g |
| N,N-Diethylhydroxylamine | 4.0 g |
| N-Ethyl-N-(2-methanesulphonamidoethyl)-4-amino-3-methylbenzene sesquisulphate | 5.0 g |
| Potassium sulphite | 0.2 g |
| Potassium carbonate | 30.0 g |

-continued

| | |
|---|---|
| Polymaleic anhydride | 2.5 g |
| Hydroxyethanediphosphonic acid | 0.2 g |
| Optical whitener (4,4'-diaminostilbene-sulphonic acid derivative) | 2.0 g |
| Potassium bromide | 0.02 g |

make up to 1000 ml with water; adjust pH value to pH 10.2 with KOH or $H_2SO_4$.

b) Bleach/fixing bath-45 seconds-35° C.

| | |
|---|---|
| Ammonium thiosulphate | 75.0 g |
| Sodium hydrogen sulphite | 13.5 g |
| Ethylenediaminetetraacetic acid (iron-ammonium salt) | 45.0 g |

make up to 1000 ml with water; adjust pH value to pH 6.0 with ammonia (25%) or acetic acid.

c) Rinsing-2 minutes-33° C.

d) Drying

The samples were then stored in darkness for 42 days at 85° C. and 60% relative humidity and the percentage change in maximum density ($\Delta D_{max}$) and the absolute change in magenta and cyan secondary density ($\Delta ND_{pp}$, $\Delta ND_{bg}$ respectively) at maximum yellow density were then determined (table 2).

TABLE 2

| Sample | Compound (g/m²) | $\Delta D_{max}$ | $\Delta ND_{pp}$ | $\Delta ND_{bg}$ |
|---|---|---|---|---|
| 1 (V) | none | −50 | +13 | +16 |
| 2 (V) | ST-7 (0.12) | −48 | +13 | +15 |
| 3 (V) | ST-8 (0.12) | −40 | +12 | +14 |
| 4 (V) | ST-9 (0.12) | −40 | +10 | +13 |
| 5 (V) | ST-10 (0.12) | −49 | +14 | +15 |
| 6 (E) | I-7 (0.12) | −22 | +5 | +7 |
| 7 (E) | I-10 (0.12) | −24 | +6 | +8 |
| 8 (V) | ST-8/ST-10 (0.06/0.06) | −39 | +10 | +12 |
| 9 (E) | ST-5/I-7 (0.06/0.06) | −24 | +5 | +8 |

(V: comparison;
E: according to the invention)

ST-7

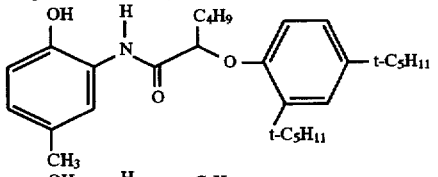

ST-8

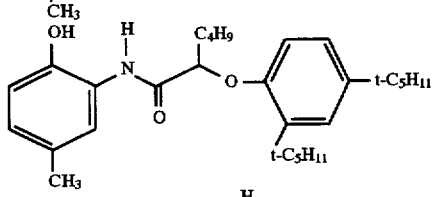

ST-9

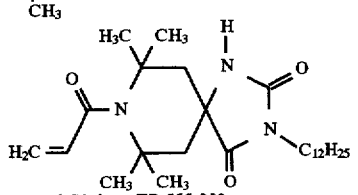

ST-10 Compound S2 from EP 555 923

As table 2 shows, the compounds according to the invention are very good dark storage stabilisers (comparison with known yellow dye stabilisers ST-7, ST-8 and ST-8) and may advantageously be combined with other dye stabilisers.

Siloxane ST-10 which has no photographically useful group according to the invention has virtually no stabilising action.

EXAMPLE 3

Samples 10 to 24

Samples 10 to 24 are produced in the same manner as sample 1 with the difference, that in layer 4 the dyestuff stabilisers ST-4 and ST-5 were replaced by the stabilisers of table 3. In the samples 16 to 20 and 21 to 24 in addition the magenta coupler M-2 is replaced by 0.13 g of magenta coupler M-3 and 0.48 g of magenta coupler M-4 respectively. In the latter case the silver application is enhanced by 60%.

The samples are then exposed behind a graduated grey wedge and processed as described in sample 1. Then the magenta maximum density is determined (Table 3) and the samples are exposed to the light of a xenon lamp with $15\times10^6$ lux h. Then the percentage of density loss is determined at starting densities of D=0.6 and D=1.4 (Table 3).

M-3

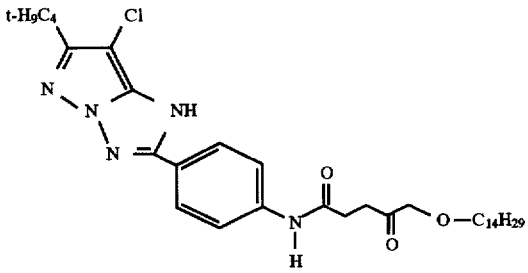

M-4

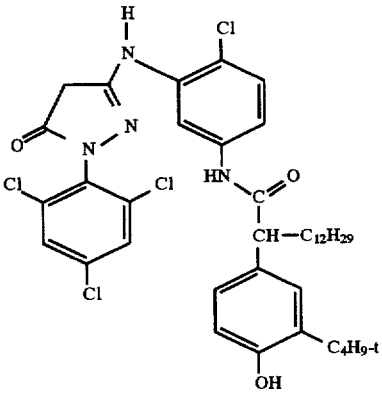

ST-11

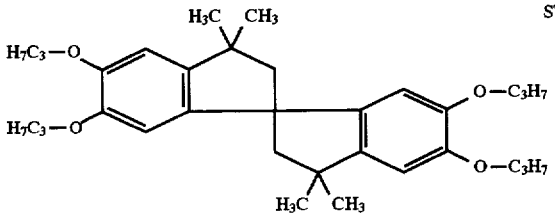

ST-12

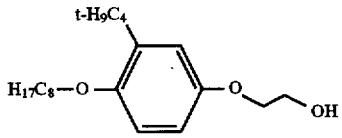

-continued

ST-13

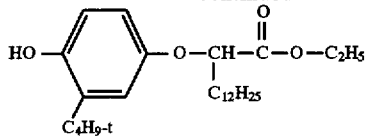

UV-5

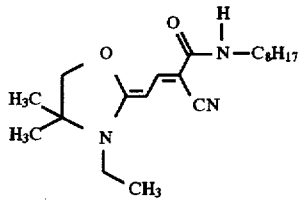

Table 3

(V: comparison, E: according to the invention)

| Sample | Compound | (g/m²) | $D_{max}$ | $\Delta D_{0,6}$ | $\Delta D_{1,4}$ |
|---|---|---|---|---|---|
| 10 (V) | none | | 2.30 | −91 | −73 |
| 11 (V) | ST-4 | (0,15) | 2.38 | −51 | −37 |
| 12 (V) | ST-12 | (0,15) | 2.23 | −62 | −41 |
| 13 (E) | I-2 | (0,15) | 2.29 | −35 | −26 |
| 14 (E) | I-6 | (0,15) | 2.40 | −30 | −22 |
| 15 (E) | I-78/I-13 | (0,10/0,05) | 2.36 | −28 | −21 |
| 16 (V) | none | | 2.22 | −71 | −59 |
| 17 (V) | ST-11 | (0,04) | 2.21 | −44 | −31 |
| 18 (V) | ST-12 | (0,04) | 2.23 | −47 | −33 |
| 19 (E) | I-2 | (0,04) | 2.21 | −30 | −21 |
| 20 (E) | I-2/I-4 | (0,02/0,02) | 2.25 | −25 | −19 |
| 21 (V) | none | | 2.28 | −68 | −43 |
| 22 (V) | ST-13 | (0,12) | 2.30 | −37 | −21 |
| 23 (E) | I-14 | (0,12) | 2.31 | −30 | −15 |
| 24 (E) | I-18 | (0,12) | 2.27 | −32 | −15 |

The compounds of the invention are very good light stabiliser for magenta couplers in comparison with the known light stabilisers for magenta dyes and can be combined successfully with each other as Table 3 shows.

EXAMPLE 4

Sample I

Onto a support of transparent polyethylene terephthalate the following layers are applied in the stated sequence. The stated quantities relate in each case to 1 m².

Layer 1: (Substrate layer)
0.2 g of gelatine

Layer 2: (UV protective layer)
0.85 g of gelatine
0.51 g of UV absorber UV-1
0.25 g of coupler solvent OF-6

Layer 3: (Protective layer)
0.7 g of gelatine
0.03 g of hardener H-2

H-2
$CH_2{=}CHSO_2CH_2SO_2CH{=}CH_2$

Samples II–IX

Samples II to IX are produced in the same manner as sample I with the difference that UV absorber UV-1 is replaced by the stated amounts of the UV absorbers of Table 4 and in samples V to IX in addition the coupler solvent is omitted.

Then the absorption maximum $\lambda_{max}$ and the absorption at $\lambda_{max}$ is determined (Table 4). Then the samples are stored 21 days at 35° C. and 95% relative humidity and the percentage of loss of absorption at $\lambda_{max}$ is determined (Table 4).

TABLE 4

| Sample | UV-absorber | (g/m²) | $\lambda_{max}$ [nm] | A ($\lambda_{max}$) | ΔA ($\lambda_{max}$) [%] |
|---|---|---|---|---|---|
| I (V) | UV-1 | (0.51) | 343 | 2.07 | −28 |
| II (V) | UV-3 | (0.54) | 349 | 1.95 | −64 |
| III (V) | UV-4 | (0.56) | 352 | 1.92 | −19 |
| IV (V) | UV-5 | (0.22) | 379 | 2.06 | −35 |
| V (E) | I-80 | (0.74) | 349 | 1.99 | −1 |
| VI (E) | I-23 | (0.40) | 346 | 2.14 | −4 |
| VII (E) | I-25 | (0.59) | 352 | 1.98 | −2 |
| VIII (E) | I-27 | (0.44) | 357 | 2.07 | −2 |
| IX (E) | I-28 | (0.22) | 380 | 2.04 | −6 |

(V: comparison,
E: according to the invention)

UV-3

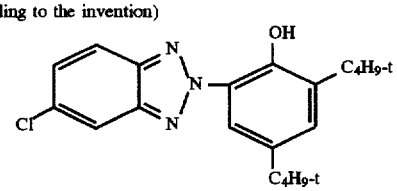

UV-4

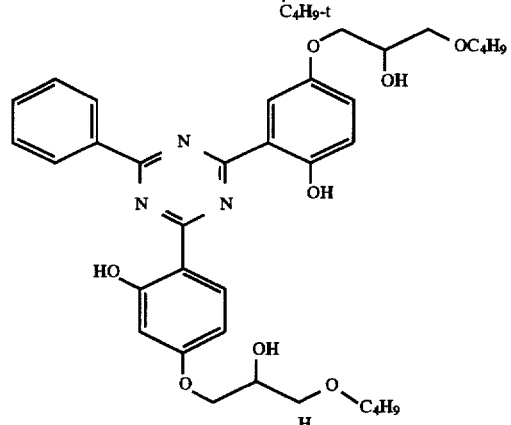

UV-5

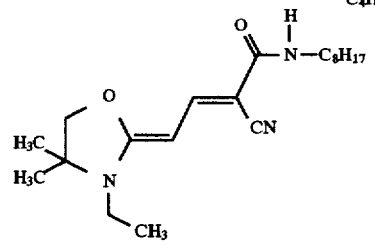

The compounds to the invention give more stable UV protective layers under tropical conditions as table 4 shows.

EXAMPLE 5

Samples N to Y

Samples N to Y are produced in the same manner as sample A with the difference that coupler Y-1 is replaced by the same amount of the couplers shown in Table 5 and the coupler solvent OF-1 is replaced by dibutyl phthalate.

The samples are then subjected to digestion testing as described for sample A (Table 5).

The colour couplers of the invention give more stable emulsions as Table 5 shows.

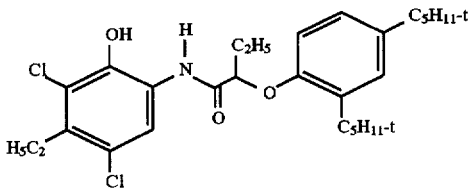

C-2

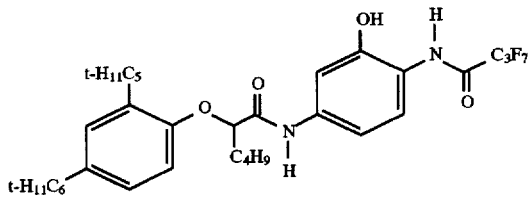

C-3

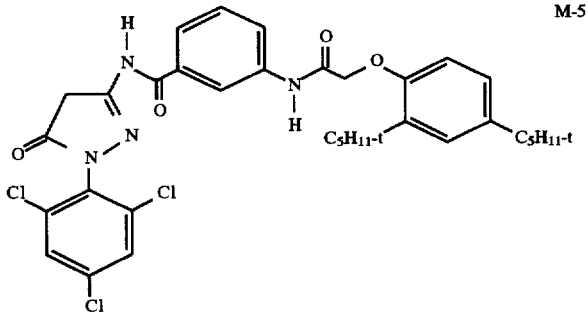

M-5

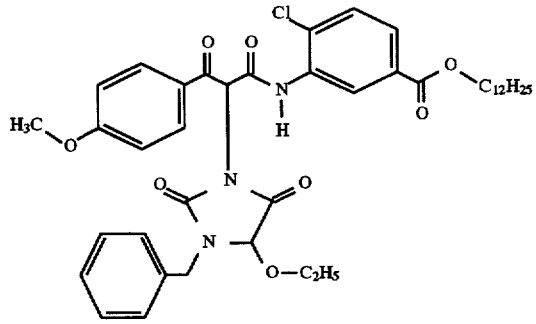

Y-3

TABLE 5

| | | (Meanings as in Table 1) | | | | | |
|---|---|---|---|---|---|---|---|
| | | after storage of | | | | | |
| | | 1 day | | | 5 days | | |
| Sample | Coupler | K | ΔT | G | K | ΔT | G |
| N (V) | Y-1 | 0 | 11 | <100 | 0 | 29 | 10.000 |
| O (V) | M-2 | – | 7 | <100 | – | 23 | 5.000 |
| P (V) | C-2 | – | 11 | <100 | 0 | 31 | 10.000 |
| Q (E) | I-53 | – | 3 | <100 | – | 10 | 500 |

TABLE 5-continued

| | | (Meanings as in Table 1) | | | | | |
|---|---|---|---|---|---|---|---|
| | | after storage of | | | | | |
| | | 1 day | | | 5 days | | |
| Sample | Coupler | K | ΔT | G | K | ΔT | G |
| R (E) | I-50 | – | 4 | <100 | – | 12 | 500 |
| S (E) | I-57 | – | 3 | <100 | – | 11 | 500 |
| T (V) | Y-3 | – | 12 | <100 | – | 28 | 5.000 |
| U (V) | M-5 | 0 | 25 | 500 | + | 87 | 50.000 |
| V (V) | C-3 | – | 15 | <100 | 0 | 41 | 10.000 |
| W (E) | I-52 | – | 3 | <100 | – | 11 | 500 |
| X (E) | I-45 | – | 2 | <100 | – | 10 | 500 |
| Y (E) | I-59 | – | 4 | <100 | – | 13 | 500 |

EXAMPLE 6

Samples 25 and 26

Samples 25 and 26 are produced in the same manner as sample 1 with the difference that the colour couplers of layers 2 (yellow), 4 (magenta) and 6 (cyan) are replaced by the colour couplers of Table 6. In sample 26 the amount of coupler solvent is reduced by 50%. Then the samples are exposed behind a wedge. Thereby filters are introduced in order to produce a neutral wedge of density 0.6. In addition the material is exposed behind a filter which is transparent for red, green or blue light in order to obtain colour separation wedges.

The neutral wedges (NK) and the colour separation wedges (FAZ) are then processed as described in sample 1. Then speed (E), gradation ($\gamma_1$ and $\gamma_2$) and maximum density ($D_{max}$) are determined (Table 6).

The colour couplers of the invention give comparable sensitometric results as comparative couplers as Table 6 shows.

TABLE 5

(V: comparison, E: according to the invention)

| Sample | Coupler layer | Coupler couple r | Coupler amount [g/m²] | NK or FAZ | Yellow E | Yellow $\gamma_1$ | Yellow $\gamma_2$ | Yellow $D_{max}$ | Magenta E | Magenta $\gamma_1$ | Magenta $\gamma_2$ | Magenta $D_{max}$ | Cyan E | Cyan $\gamma_1$ | Cyan $\gamma_2$ | Cyan $D_{max}$ |
|---|---|---|---|---|---|---|---|---|---|---|---|---|---|---|---|---|
| 1 (V) | 2 | Y-2 | 0.60 | NK | 1.40 | 187 | 390 | 239 | 1.36 | 204 | 357 | 242 | 1.41 | 187 | 383 | 268 |
| | 4 | M-2 | 0.20 | FAZ | 1.30 | 181 | 364 | 223 | 1.28 | 196 | 316 | 220 | 1.39 | 180 | 384 | 260 |
| | 6 | C-1 | 0.36 | | | | | | | | | | | | | |
| 25 (E) | 2 | I-53 | 0.55 | NK | 1.45 | 194 | 400 | 243 | 1.40 | 215 | 378 | 248 | 1.43 | 193 | 390 | 272 |
| | 4 | I-50 | 0.20 | FAZ | 1.34 | 186 | 372 | 226 | 1.32 | 201 | 334 | 227 | 1.40 | 184 | 388 | 263 |
| | 6 | I-57 | 0.36 | | | | | | | | | | | | | |
| 26 (E) | 2 | I-53 | 0.55 | NK | 1.39 | 187 | 391 | 238 | 1.36 | 202 | 356 | 241 | 1.40 | 186 | 384 | 267 |
| | 4 | I-47 | 0.12 | FAZ | 1.28 | 180 | 363 | 221 | 1.27 | 194 | 315 | 218 | 1.39 | 178 | 384 | 258 |
| | 6 | I-57 | 0.36 | | | | | | | | | | | | | |

EXAMPLE 7

Samples 27 to 36

Samples 27 to 36 are produced in the same manner as sample 1 with the difference that in layer 3 and in layer 5 TCP, SC-1 and 2.5-ditertiary-octyl hydroquinone are replaced by 0.08 g of the compounds of Table 7. In addition in layer 4 the magenta coupler M-2 is replaced by 0.24 g of magenta coupler M-1.

The samples are exposed behind a graduated grey wedge through a filter transparent for green light and processed as described for sample 1. Then the percentage of yellow and cyan secondary density ($ND_{gb}$, $ND_{bg}$) are determined at a magenta density of 1.0 (Table 7).

Then the samples are exposed to the light of a 10 klux xenon lamp with $20\times10^6$ lux h and the percentage of density loss is determined at a starting magenta density of $D_{pp}=1.0$ ($\Delta D_{1,0}$) (Table 7).

Table 7

(V: comparison, E: according to the invention)

| Sample | Compound | $ND_{gb}$ [%] | $ND_{bg}$ [%] | $\Delta D_{1,0}$ [%] |
|---|---|---|---|---|
| 27 (V) | none | 26.4 | 16.4 | −42 |
| 28 (V) | SC-2 | 24.2 | 8.2 | −73 |
| 29 (V) | SC-3 | 24.4 | 8.6 | −57 |
| 30 (V) | SC-4 | 25.4 | 9.6 | −44 |
| 31 (E) | I-31 | 24.3 | 8.3 | −45 |
| 32 (E) | I-33 | 24.1 | 8.1 | −45 |
| 33 (E) | I-34 | 24.3 | 8.4 | −42 |
| 34 (E) | I-62 | 22.3 | 7.4 | −43 |
| 35 (E) | I-63 | 23.9 | 6.8 | −41 |
| 36 (E) | I-64 | 23.6 | 8.0 | −42 |

SC-2

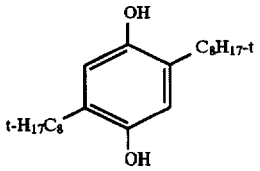

SC-3

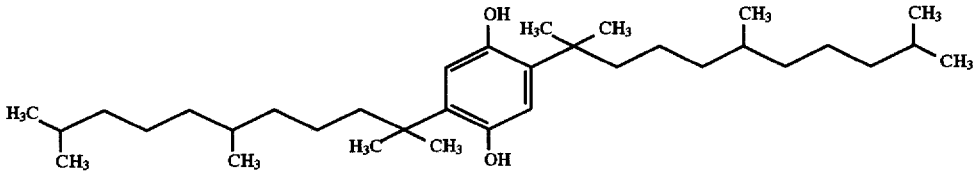

SC-4

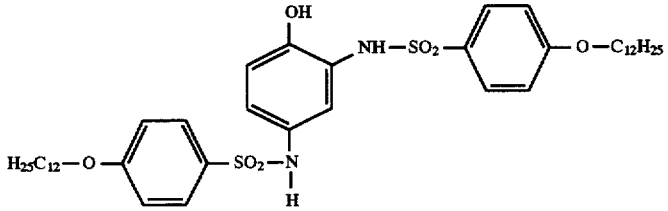

The compounds of the invention are as effective as EOP scavenger as comparative compounds SC-2 and SC-3 without influencing the light stability of the magenta dye as Table 7 shows.

We claim:

1. Photographic material comprising at least one photosensitive silver halide emulsion layer and at least one non-photosensitive layer on a support, which said material contains at least one compound of the formula (I) in at least one of the layers,

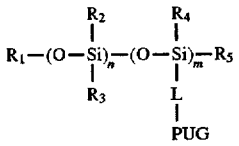

(I)

in which $R_1$ means H, alkyl, $Si(CH_3)_3$ or, together with $R_5$, a direct bond, $R_2$ and $R_4$ are identical or different and mean hydroxy, alkoxy, alkyl, phenyl, $—OSi(CH_3)_3$ or $—OSi(OR_6)$, $R_3$ means alkyl, aryl or alkenyl, $R_5$ means OH, alkoxy, $—OSi(CH_3)_3$ or, together with $R_1$, a direct bond, $R_6$ means alkyl, L means a divalent linking member, PUG is of one of the formulae (XIII) to (XVI) and the compounds of formulae (XIII) to (XVI) are attached to the polysiloxane skeleton via one of their substituents and the group L

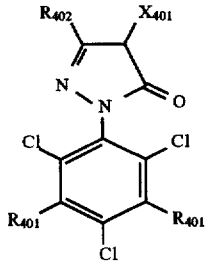

(XIII)

$R_{401}$ means H or Cl, $R_{402}$ means alkylcarbonylamino, arylcarbonylamino or anilino and $X_{401}$ means H, Cl, a nitrogen containing heterocycle linked via the N-atom, arylthio, alkylthio or aryloxy:

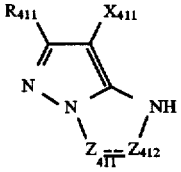

(XIV)

wherein $R_{411}$ means alkyl or aryl $Z_{411}$ means —N= and $Z_{412}—C(R_{412})=$ or $Z_{411}$ means $—C(R_{412})=$ and $Z_{412}—N=$ $R_{412}$ means alkyl or aryl and $X_{411}$ means H, Cl, aryloxy, a nitrogen containing heterocycle linked via the N-atom, alkylthio or arylthio,

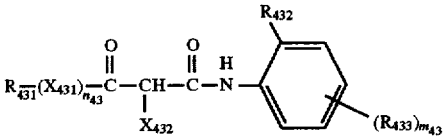

(XV)

wherein $R_{431}$ means alkyl or aryl, $R_{432}$ means alkoxy, halogen or aryloxy, $R_{433}$ means acyl, acylamino, alkyl aryl, alkoxy or halogen, $X_{431}$ means $—N(R_{431})—$, $X_{432}$ means a nitrogen containing heterocycle linked via the N atom, $n_{43}$ means 0 or 1 and $m_{43}$ means 1 or 2, and wherein two radicals $R_{431}$ can form a five to seven membered ring;

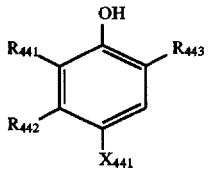

(XVI)

wherein $R_{441}$ means H, Cl or alkoxy, $R_{442}$ means alkyl or acylamino, $R_{443}$ means H or acylamino and $X_{441}$ means H, Cl, acyloxy, alkoxy, aryloxy, alkylthio or arylthio or $R_{441}$ and $R_{442}$ may form an anellated, optional substituted benzene or oxazole ring n means 0 to 100 and m means 2 to 100.

2. Photographic material according to claim 1, wherein $R_1$ means H or $Si(CH_3)_3$, $R_2$ and $R_4$ means $CH_3$, $R_3$ means alkyl, $R_5$ means OH or $OSi(CH_3)_3$, $R_6$ means $C_1$–$C_4$ alkyl, L means $—(L_a)—(L_b)_r—(CH_2)_s—(L_c)_t—(L_d)_u—(L_c)_v—$, r, s, t, u and v are identical or different and mean 0 or 1, $L_a$ means alkylene, $L_b$ means arylene, $L_c$ means —O— or $—NR_7—$, $L_d$ means —CO—, $L_e$ means alkylene, arylene or aralkylene and $R_7$ means H, alkyl or aryl, wherein $L_a$ is $—CH_2—CR_8R_9$ if r is 1 and s is 0 if r is 0 and $R_8$ and $R_9$ are identical or different mean H or $CH_3$.

3. Photographic material according to claim 1, wherein

L means $—CH_2—CH_2—L_b—L_h—$,

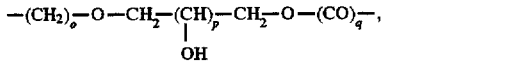

-continued $$-(CH_2)_o-L_f-L_e-L_g- \quad \text{or} \quad -(CH_2)_o-O-,$$

o means an integer greater than 2, p means 0 or 1, q means 0 or 1, $L_b$ is arylene, $L_e$ is alkylene, arylene or aralkylene, $L_f$ means —O—, —OCO— or —O—CO—NH—, $L_g$ means —O—, —CO— or —O—CO— and $L_h$ means —O—, —$NR_3$, —OCO or —NHCO—.

4. Photographic material according to claim 1, wherein the compound of the formula (I) is used in at least one layer in a quantity of 0.001 to 5 g/m$^2$ of material.

5. The photographic material according to claim 3, wherein o is 3.

6. Photographic material comprising at least one photosensitive silver halide emulsion layer and at least one non-photosensitive layer on a support, which said material contains at least one compound of the formula (I) in at least one of the layers,

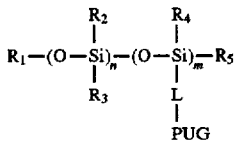

(I)

in which $R_1$ means H, alkyl, $Si(CH_3)_3$ or, together with $R_5$, a direct bond, $R_2$ and $R_4$ are identical or different and mean hydroxy, alkoxy, alkyl, phenyl, —$OSi(CH_3)_3$ or —$OSi(OR_6)$, $R_3$ means alkyl, aryl or alkenyl, $R_5$ means OH, alkoxy, —$OSi(CH_3)_3$ or, together with $R_1$, a direct bond, $R_6$ means alkyl, L means a divalent linking member, PUG means a dye stabilizer group of formulae II or IV which are attached to the polysiloxane skeleton via one of their substituents and the group L, n means 0 to 100 and m means 2 to 100.

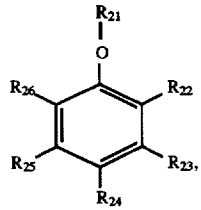

(II)

wherein $R_{21}$ means H, alkyl, aryl, acyl or alkenyl, $R_{22}$ to $R_{26}$ are identical or different and mean H, alkyl, alkenyl, aryl, acyl, acylamino, acyloxy, alkoxy, aryloxy, halogen, —COOH, —$SO_3H$, cyano or —$N(R_{27})R_{28}$, $R_{27}$ and $R_{28}$ are identical or different and mean H, alkyl or aryl, $R_{24}$ is not H if $R_{21}$ is H or acyl and adjacent residues $R_{21}$ to $R_{28}$ may also form a 5- to 8-membered ring;

$$R_{41}-S-R_{42} \qquad \text{(IV)},$$

in which $R_{41}$ and $R_{42}$ are identical or different and mean alkyl, aryl, alkenyl and $R_{41}$ and $R_{42}$ may form a 5-to 8-membered ring.

7. Photographic material according to claim 6, wherein $R_1$ means H or $Si(CH_3)_3$, $R_2$ and $R_4$ means $CH_3$, $R_3$ means alkyl, $R_5$ means OH or $OSi(CH_3)_3$, $R_6$ means $C_1$–$C_4$ alkyl, L means $-(L_a)-(L_b)_r-(CH_2)_s-(L_c)_t-(L_d)_u-(L_c)_v-$, r, s, t, u and v are identical or different and mean 0 or 1, $L_a$ means alkylene, $L_b$ means arylene, $L_c$ means —O— or —$NR_7$—, $L_d$ means —CO—, $L_e$ means alkylene, arylene or aralkylene and $R_7$ means H, alkyl or aryl, wherein $L_a$, is —$CH_2$—$CR_8R_9$ if r is 1 and s is 0 if r is 0 and $R_8$ and $R_9$ are identical or different mean H or $CH_3$.

8. Photographic material according to claim 6, wherein

L means —$CH_2$—$CH_2$—$L_b$—$L_h$—, $$-(CH_2)_o-O-CH_2-\underset{\underset{OH}{|}}{(CH)_p}-CH_2-O-(CO)_q-,$$

$$-(CH_2)_o-L_f-L_e-L_g- \quad \text{or} \quad -(CH_2)_o-O-,$$

o means an integer greater than 2, p means 0 or 1, q means 0 or 1, $L_b$ is arylene, $L_e$ is alkylene, arylene or aralkylene, $L_f$ means —O—, —OCO— or —O—CO—NH—, $L_g$ means —O—, —CO— or —O—CO— and $L_h$ means —O—, —$NR_3$, —OCO or —NHCO—.

9. Photographic material according to claim 6, wherein the compound of the formula (I) is used in at least one layer in a quantity of 0.001 to 5 g/m$^2$ of material.

* * * * *